US005779391A

United States Patent [19]

Knight

[11] Patent Number: 5,779,391

[45] Date of Patent: Jul. 14, 1998

[54] REVETMENT BLOCK

[75] Inventor: David W. Knight, Humble, Tex.

[73] Assignee: Keystone Retaining Wall Systems, Inc., Bloomington, Minn.

[21] Appl. No.: 752,694

[22] Filed: Nov. 19, 1996

[51] Int. Cl.[6] ..... E02B 3/12

[52] U.S. Cl. ..... 405/20; 404/41; 405/16

[58] Field of Search ..... 405/16–21, 29–35, 405/258; 404/35, 41, 40; 52/590.1; 428/169, 60

[56] References Cited

U.S. PATENT DOCUMENTS

| | | | |
|---|---|---|---|
| Re. 32,663 | 5/1988 | Atkinson . | |
| 2,674,856 | 4/1954 | Louckes . | |
| 2,876,628 | 3/1959 | Dixon, Jr. . | |
| 3,597,928 | 8/1971 | Pilaar . | |
| 4,172,680 | 10/1979 | Brown . | |
| 4,201,494 | 5/1980 | Crowe . | |
| 4,227,829 | 10/1980 | Landry, Jr. . | |
| 4,286,895 | 9/1981 | Poli et al. . | |
| 4,370,075 | 1/1983 | Scales . | |
| 4,375,928 | 3/1983 | Crow et al. . | |
| 4,417,828 | 11/1983 | de Winter . | |
| 4,436,447 | 3/1984 | Crowe . | |
| 4,474,504 | 10/1984 | Whitman et al. . | |
| 4,497,858 | 2/1985 | Dupont | 404/41 X |
| 4,564,311 | 1/1986 | Scales . | |
| 4,621,942 | 11/1986 | Hill | 404/41 |
| 4,664,552 | 5/1987 | Schaaf . | |
| 4,683,156 | 7/1987 | Waters . | |
| 4,773,790 | 9/1988 | Hagenah | 404/41 |
| 4,875,803 | 10/1989 | Scales . | |
| 5,028,167 | 7/1991 | Scheiwiller | 404/41 |
| 5,087,150 | 2/1992 | McCreary . | |
| 5,107,652 | 4/1992 | Sosa . | |
| 5,108,222 | 4/1992 | Jansson et al. . | |
| 5,133,620 | 7/1992 | Scheiwiller | 404/37 |
| 5,160,215 | 11/1992 | Jensen . | |
| 5,222,342 | 6/1993 | Defferrari . | |
| 5,224,792 | 7/1993 | Hagenah | 404/41 X |
| 5,348,417 | 9/1994 | Scheiwiller | 404/41 |
| 5,429,451 | 7/1995 | Pettee, Jr. . | |
| 5,484,230 | 1/1996 | Rudloff . | |

*Primary Examiner*—Dennis L. Taylor
*Attorney, Agent, or Firm*—Popovich & Wiles, P.A.

[57] ABSTRACT

A revetment block for use in a revetment system, the block having top and bottom surfaces and pairs of opposed and substantially parallel side surfaces. One of the side surfaces in each of the opposed pairs has first and second projections and the other of the side surfaces in each of the opposed pairs has first and second recesses. The projections and recesses are sized and configured so that they mate with projections and recesses on the side surfaces of adjacent blocks. The bottom surface of the block may be provided with projections to enhance the frictional stability of the blocks. The blocks are connected together by cables which pass through tunnels between the side surfaces of the blocks. A sleeve fitted into each opening of the tunnel in the side surface is provided to protect the cables from breakage.

36 Claims, 19 Drawing Sheets

REVETMENT BLOCK

FIELD OF THE INVENTION

The present invention relates to an improved revetment block for use in a system of interlocking modular concrete blocks tied together into a matrix to control soil erosion in applications where moving water is present. The system may be used to control erosion in a variety of settings where water moves across or against the sides or bottom of a channel, embankment or shoreline. The system may be installed above or below the waterline.

BACKGROUND OF THE INVENTION

The use of articulating block matrices for soil erosion prevention is known in the art. Typically, such systems involve the grading of an embankment or shoreline to a predetermined slope, the installation of a highly water permeable geosynthetic fabric over the soil substrate, and then the placement over the fabric of a matrix of blocks. A typical matrix of blocks is comprised of precast concrete blocks, tied together into mats with cables usually comprised of high strength polyester or galvanized steel. These mats are typically assembled off-site at a block precasting facility. After the blocks are cast, cables are strung through ducts in the blocks, typically producing mats that are approximately 8 feet wide and 40 feet long. Mats of this size have proven convenient for handling and transporting to the job site. The assembled mats are lifted onto a truck or barge for transportation to the job site using a crane or large forklift truck equipped with a spreader bar assembly which suspends the mats in a generally horizontal orientation. At the installation site, the mats are placed side by side by a crane using a spreader bar assembly. The cables of adjacent mats are bonded together so that the finished installation comprises a continuous matrix of concrete blocks. The openings in the resulting surface may be backfilled with soil and seeded to produce vegetation. The presence of vegetation produces an aesthetically appealing shoreline and also provides greater resistance to erosion.

A revetment system constructed in this manner relies on the combination of the permeable fabric and the articulating concrete block surface to overcome the erosive effects of flowing water or waves to hold in place the underlying soil. Such systems have been widely used, and there are numerous examples of revetment systems that operate in the general fashion described above, including those described in U.S. Pat. No. 4,227,829 (Landry), U.S. Pat. No. 4,370,075 (Scales) and a system marketed by Revetment Systems, Inc. under the tradename PETRAFLEX™ Revetment System.

The revetment system described in the Landry patent shows a matrix of blocks arranged such that the blocks are arrayed in parallel transverse rows and parallel longitudinal columns. The blocks are not shaped to interlock with each other in the matrix but are connected together with sets of cables passing through tunnels in the blocks. One set of cables passes through the entire transverse dimension of the matrix and another set passes through the entire longitudinal dimension of the matrix. For convenience, this system is referred to as a "dual cable system" below. The blocks have angular tapered sides such that the top surface of the block has less surface area than the bottom surface, to facilitate articulation of the matrix over non-planar surfaces and bowing of the matrix when it is suspended from a spreader bar assembly.

Like Landry, the revetment system described in Scales is a matrix of blocks placed in parallel transverse rows, with cable interconnections. The blocks also have angular tapered sides to facilitate articulation. Unlike Landry, the revetment system described in Scales uses cables that travel only in the longitudinal direction and each block has two longitudinal tunnels for the cables. For convenience, this system is referred to as a "single cable system" below. The blocks of Scales are of a generally rectangular shape, with recesses and protrusions in the sidewalls configured so that longitudinally adjacent blocks interlock when the blocks are placed in a "running bond" pattern in the matrix by off-setting adjacent transverse rows in the transverse direction.

In the PETRAFLEX™ System the blocks are, like the blocks of Landry, generally square, and are placed in parallel columns and rows with a dual cable system. Two tunnels, each accepting one cable, are used in the longitudinal direction, and one tunnel, accepting one cable, is oriented in the transverse direction. Unlike Landry, the block of the PETRAFLEX™ system has, for each pair of sidewalls, one male tab on a side opposed to one female tab on the other side to interlock adjacent blocks when placed in a matrix with parallel rows and columns of like blocks.

The manner in which the blocks are placed into a matrix is an important design feature of articulating block revetment systems. The prior art teaches the use of cables connecting the blocks and providing a block to block interlock by shaping the blocks so that they nest together when placed in a matrix. The prior art also includes blocks that are laid without using interconnecting cables and which rely on the unit mass and block to block interlock to maintain the blocks in place. The dual cable systems perform well, but require additional cable over that required by the single cable systems, and are more costly as a result. The single cable systems and systems not using any cables do not perform as well as the dual cable systems, but may be more cost-effective for certain applications. While the use of cables is desirable for system strength and to prevent removal by vandals, blocks without cables can be hand-placed, which is an advantage in certain applications. For all systems, performance is improved by increasing the amount of block to block interlock to restrict lateral movement of adjacent blocks.

Each of the Scales, Landry and PETRAFLEX™ system block designs are designed to be placed into a matrix in only one way and with only one cabling system. There is a need for an easily manufactured block that can be constructed into multiple matrix configurations with a high degree of interlock between adjacent blocks to suit the design requirements of varying site conditions, so that the blocks can be configured to function with a multiple cable system, a single cable system, or no cables at all.

Another important design consideration for revetment systems is their ability to allow water to flow through the surface of the concrete mats. In most settings where such systems are used, water may be present in the soil substrate underneath the layer of geotextile and the concrete block mat. Such water may be introduced through rainfall, surface flows, wave action, subsurface groundwater flows or other elements. As a result, it is highly desirable that the surface of the block matrix be permeable so that the matrix is not displaced by hydrostatic pressure or undermined by erosion caused by flows occurring in the soil substrate beneath the block matrix and geotextile. It is common practice to have open voids in the matrix consist of approximately twenty percent (20%) of the total surface of the block matrix. Such voids are located either within the blocks or in the spaces between the blocks when they are placed in the matrix. There are also instances, however, where a unit without such open voids may be desired.

While such openings are highly desirable, they do introduce an element of vulnerability to displacement of the blocks, because such voids may allow wave action or water flows to destabilize or undermine the matrix. Thus, there is a need for an improved design for such voids that minimizes the disruptive effect of hydrodynamic forces while providing sufficient open area to allow the release of water that may accumulate beneath the surface of the matrix. Such a design ideally should be able to address the fact that hydrodynamic forces may act on the revetment structure from different directions in different applications. For example, when the revetment is intended to protect a river embankment, the forces typically will come from the flow of water along the transverse direction of the matrices. When the revetment is installed to protect a darn overtopping, then the forces are oriented along the longitudinal direction. When the revetment is installed along a shoreline, the forces may be along the longitudinal direction, or diagonal to it. Thus, the orientation of the forces is an important factor in addressing the hydraulic efficiency of the revetment matrix. To adequately address this issue could require a multitude of different block designs, but such a multitude does not allow economies of scale in production, and complicates and increases the expense of the manufacturing process. There is a need for one multipurpose block that is capable of being placed in multiple orientations in a prefabricated matrix such that it can have maximum hydraulic efficiency for the particular, and potentially conflicting, requirements of different jobs.

Another important factor regarding the configuration of the block openings is the dispersion of the openings across the top surface of the block to allow greater coverage and concealment of the block structure by vegetation that is planted in the openings. There is a need for a block that spreads the openings in the block widely across the top surface to allow greater vegetation coverage.

Another important characteristic of a revetment system is the shear resistance of the block, geofabric and soil interface. The blocks used in the prior art revetment systems have planar bottom surfaces and rely simply on the weight of the blocks and friction to overcome shear forces at this interface. In some instances, this has resulted in local system failures. The performance of the system could be significantly enhanced by improving the shear resistance of the geofabric and block matrix against lateral displacement along the soil interface. There is a need for a block design which has a cost-effective gripping configuration built into its bottom surface to improve the shear strength at this lower interface.

Finally, there is a need for more cost-effective means of protecting the cables that tie the blocks together against abrasion. During the process of handling the mats after they are assembled, the mats are lifted using the cables. This results in weakening of the cables at the mouths of the tunnels of the blocks where the cables rub against the rough surface of the concrete. This problem has been addressed in the prior art by providing for an insert that is passed through the entire length of the matrix (See U.S. Pat. No. 4,227,829 to Landry). While such approaches serve their intended purpose, there is a need for a less expensive means of accomplishing the task of protecting the cables against abrasion at critical locations.

SUMMARY OF THE INVENTION

In accordance with the present invention there is disclosed a block for use in a revetment system. The block comprises a top surface, a bottom surface and first and second opposed and substantially parallel side surfaces that extend between the top and bottom surfaces, and third and fourth opposed and substantially parallel side surfaces extending between the top and bottom surfaces and the first and second side surfaces. The first and third side surfaces each have first and second projections and the second and fourth side surfaces each have first and second recesses. The projections and recesses are sized such that the projections on the first and third side surfaces mate with the recesses on the second and fourth side surfaces, respectively, of an adjacent block in a revetment system which comprises a plurality of the blocks arranged to form a mat. The blocks may be arranged in either a parallel row and column configuration or in a running bond configuration with either the rows or columns off-set.

The block may have at least one tunnel extending between either the first and second opposed side surfaces or the third and fourth opposed side surfaces. This enables the block to be connected to other blocks in the mat using cabling inserted through the tunnel. In some variations two or more tunnels may be provided between each of the opposed side surfaces. In particular, a universal type block may comprise three tunnels between each of the opposed side surfaces.

The side surfaces of the block may include a portion which is tapered inwardly towards the top surface such that the area of the top surface is less than the area of the bottom surface. The tapered portion may comprise a curve having a single radius, a curve having multiple radii or a logarithmic curve.

The recesses and projections of each side surface extend in a substantially vertical direction between the top and bottom surfaces of the block and may be tapered. The sides surfaces of the block intersect to form corners which may be truncated between the top and bottom surfaces.

Each block includes at least one opening between the top and bottom surfaces. The openings may be shaped in the form of elongate slots or may consist of a series of holes or lines of linearly positioned holes arranged in a linear array. The configuration of the block allows the block to be assembled into a mat with the elongate slots or linear holes parallel to the longitudinal sides of the mat or transverse to the longitudinal sides of the mat, depending upon the direction of the flow of water.

The block may further include an elongate sleeve positioned in each tunnel which is to receive a cable. The elongate sleeve extends from the side surface into which it is inserted for a distance not exceeding one-half of the distance to the opposing side surface. The elongate sleeve protects the cable which connects the blocks in the mat from abrasion. The sleeve is preferably provided with a projection which frictionally engages the interior surface of the tunnel to provide additional frictional connection between the sleeve and the interior of the tunnel. The sleeve comprises an interior surface and an exterior surface which engages the inner surface of the tunnel. The interior surface of the sleeve may be tapered towards the exterior surface of the sleeve in a direction opposite the side surface into which the sleeve is inserted.

The top and bottom surfaces of the block are substantially planar and parallel to one another. The first and third side surfaces of the block include substantially planar central sections extending between the first and second projections and the top and bottom surfaces. The second and fourth side surfaces of the block have substantially planar central sections extending between the first and second recesses and the top and bottom surfaces. The central planar sections are configured such that lines which extend along edges formed by intersections of the central planar sections and a central plane substantially parallel with and lying between the top and bottom surfaces intersect to form a rectangle. The rectangle may be a square. The rectangle has a first pair of opposed sides having a length $D_1$ and a second pair of opposed sides having a length $D_2$. A center point of each of the first and second recesses and the first and second projections is located on one of first, second, third and fourth planes, each of the planes being perpendicular to the top and bottom surfaces and to either the first pair of opposed sides of the rectangle or the second pair of opposed sides of the rectangle. The first plane intersects the first pair of opposed sides of the rectangle a distance D 1/4 from two of the corners of the rectangle and the second plane intersects the first pair of opposed sides of the rectangle a distance D 1/4 from the other two corners of the rectangle. The third plane intersects the second pair of opposed sides of the rectangle a distance $D_2/4$ from two of the comers of the rectangle and the fourth plane intersects the second pair of opposed sides of the rectangle a distance $D_2/4$ from the other two corners of the rectangle.

The center point of each of the central planar sections is located along either a fifth plane or a sixth plane. The fifth and sixth planes are perpendicular to the top and bottom surfaces and to one pair of the opposed sides of the rectangle. The fifth plane is perpendicular to and intersects the first pair of opposed sides of the rectangle a distance D 1/2 from the corners of the rectangle. The sixth plane is perpendicular to and intersects the second pair of opposed sides of the rectangle a distance D 2/2 from the corners of the rectangle.

In one embodiment the invention is a block for use in a revetment system. The block comprises a top surface and an opposed bottom surface. The block has first and second opposed side surfaces extending between the top and bottom surfaces and third and fourth opposed side surfaces extending between the top and bottom surfaces and the first and second side surfaces. The first and second side surfaces have a portion which is tapered inwardly towards the top surface such that the area of the top surface is less than the area of the bottom surface, the tapered portion comprising a curve having at least one radii or a logarithmic curve.

In another embodiment the invention is a block for use in a revetment system. The revetment system includes a fabric sheet and a plurality of blocks arranged to form a mat. The fabric sheet is positioned between the bottom surface of the blocks in the mat and a soil substrate for the purpose of controlling soil erosion. Each block has a top surface, a bottom surface, first and second opposed side surfaces extending between the top and bottom surfaces and third and fourth opposed side surfaces extending between the top and bottom surfaces and the first and second side surfaces. The bottom surface of each block has projections extending away from the bottom surface in a manner such that when the block is used in the revetment system the projections extend into the fabric sheet to increase the frictional stability of the revetment system. The projections may be in the shape of truncated cones or elongate ridges.

Other features and advantages of the present invention will be made apparent from the following description of the drawings, the detailed description and the appended claims.

BRIEF DESCRIPTION OF THE DRAWINGS

FIGS. 19A-1 and 19B-1 are partial sectional views taken along lines 19A—19A of FIG. 19A and 19B—19B of FIG. 19B.

DETAILED DESCRIPTION OF THE INVENTION

The Revetment Block

Figure 1:
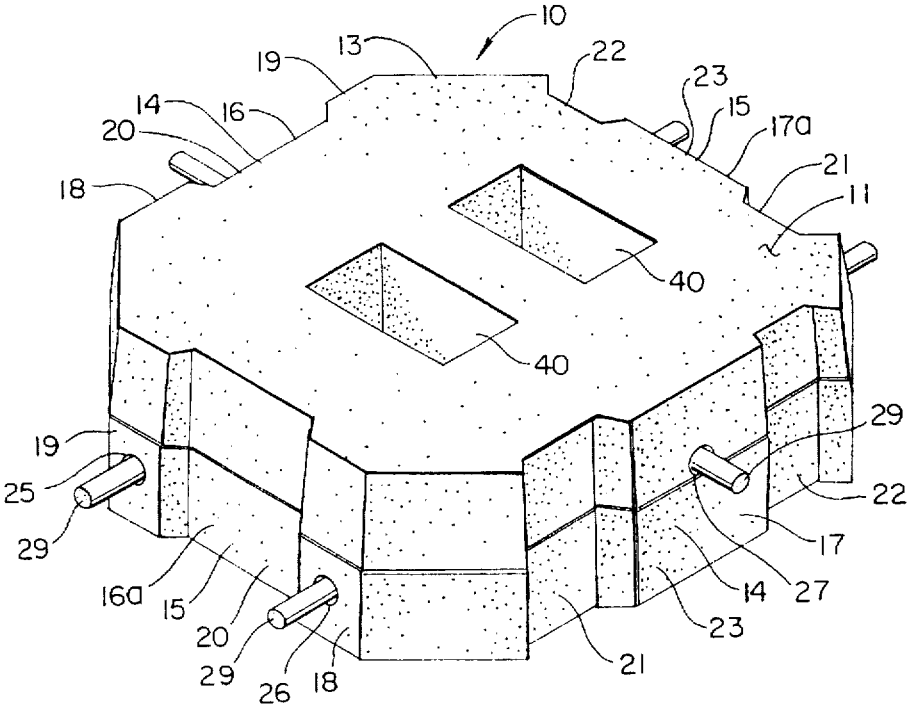
FIG. 1 is a perspective view of one embodiment of a revetment block according to the present invention.
Figure 1A:
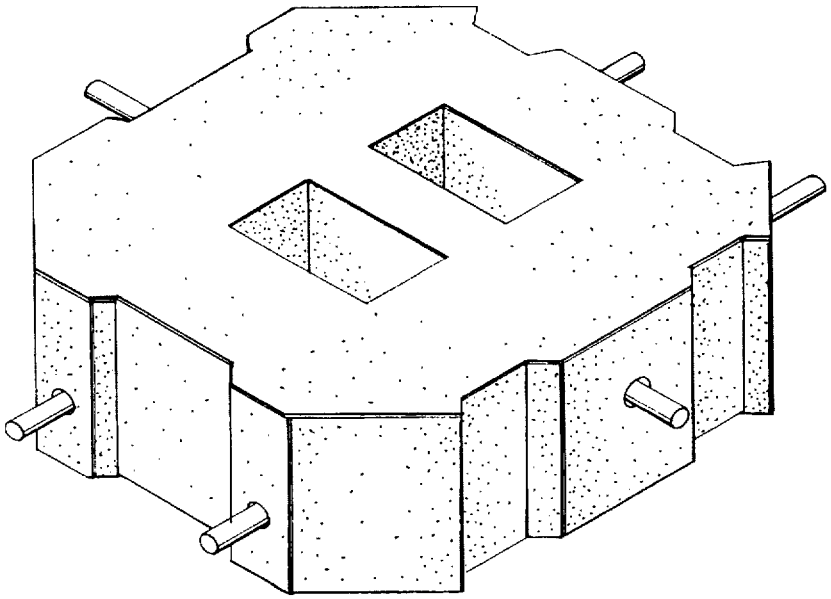
FIGS. 1A, 1B, 1C and 1D are perspective views of alternative variations of revetment blocks similar to the block of FIG. 1.

Referring now to FIGS. 1, 2, 3, 4, 5 and 6 of the drawings, views of a precast concrete block according to a first embodiment of the present invention are shown from a perspective view, a top view, two side views, and front and back views, respectively. In FIG. 1 a perspective view of the block is shown. In a preferred embodiment, shown generally at 10, the block has substantially planar top and bottom surfaces 11 and 12, each being spaced from and parallel to the other. The top 11 and bottom 12 are both generally square, but may have truncated comers 13. Block 10 has four side surfaces extending from lateral edges of the top and bottom surfaces in two pairs of opposed side surfaces, 14 and 15. The height of the side surfaces varies depending on site requirements. A height of 4 inches is commonly used, but in conditions involving greater hydrodynamic forces, the heights may increase to more than 12 inches.

Opposed side surfaces 14 are generally parallel to each other and opposed side surfaces 15 are generally parallel to each other. Opposed side surfaces 14 comprise generally parallel first and second side surfaces 16 and 17. Opposed side surfaces 15 comprise generally parallel third and fourth side surfaces 16*a* and 17*a*. The first side surface 16 has a first projection 18 and a second projection 19. Between first projection 18 and second projection 19, there is a planar central section 20. The second side surface 17 has a first recess 21 and second recess 22 which are opposed to the first projection 18 and second projection 19, respectively. Between first and second recesses 21 and 22, there is a planar central section 23, which is opposed to and of equal proportions to planar central section 20 of first side surface 16. Third side surface 16*a* is of substantially identical shape to side surface 16 and has first and second projections 18 and 19 and central planar section 20. Similarly, fourth side surface 17*a* is of substantially identical shape to side surface 17 and has first and second recesses 21 and 22 and central planar section 23.

The recesses 21 and 22 and projections 18 and 19 are oriented vertically and are all of equal proportions. This configuration allows either projection 21 or 22 on one surface to mate with either recess 18 or 19 on the opposite side surface of an adjacent block in the revetment mat. Additionally, this configuration allows maximum design flexibility since the blocks will interlock when the revetment mat is formed of blocks in either a parallel column and row configuration or a running bond configuration. Additionally, configuring the blocks in this manner allows them to be assembled into a mat in a particular orientation, or they may be rotated 90°. The recesses 21 and 22 and projections 18 and 19 may be curvilinear, angled, "u" shaped, "v" shaped or otherwise configured so that they are symmetrical around a central vertical plane perpendicular to the side surface and intersecting the horizontal midpoint of the recess or projection.

Block 10 may have one or more through holes or voids 40 which are open from the top surface 11 through bottom surface 12. Preferably, each of the side surfaces of the block 10 includes a tapered portion 41.

Figure 2:
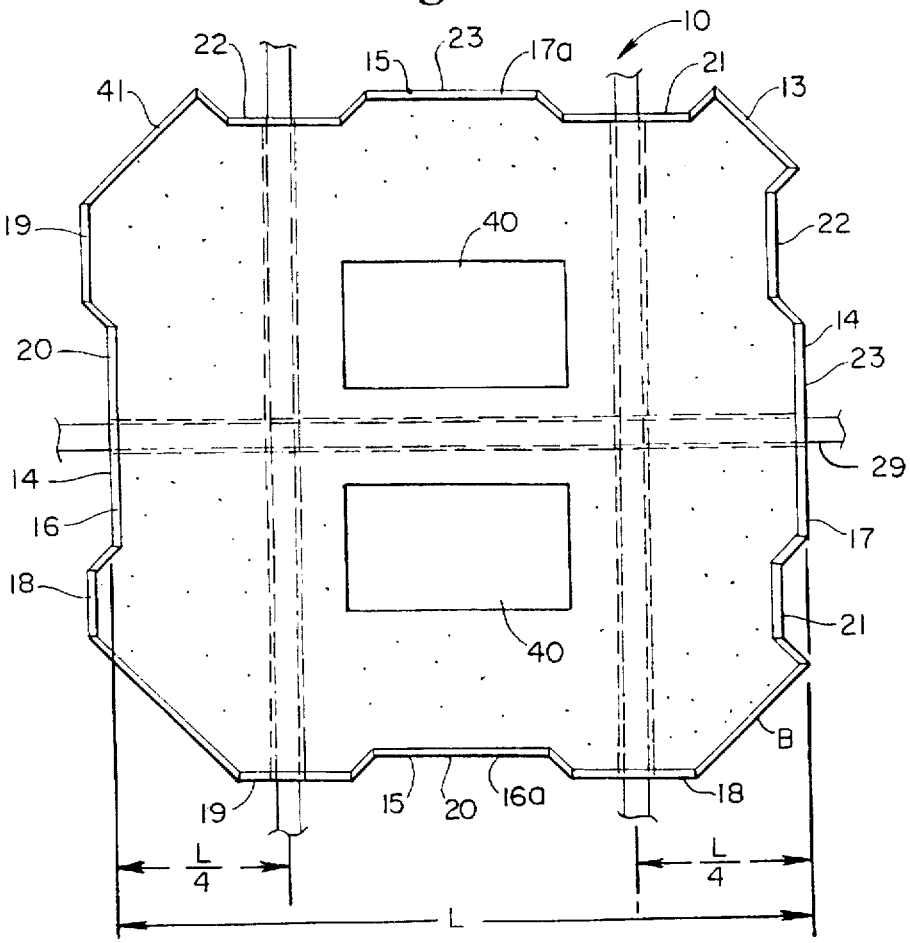
FIG. 2 is a top view of the revetment block of FIG. 1.

Preferably, the recesses and projections are located along the side surfaces by reference to the length of the sides of a square formed by horizontal lines extending from the planar central sections 20 and 23. As seen in FIG. 2, the square has a dimension "L" equal to the length of each side of the square so defined. On both pairs of opposing side surfaces 14 and 15 the center point of the first and second recesses 21 and 22 and projections 18 and 19, are located one-fourth of the length of dimension L away from the respective corners of the defined square.

Blocks of the present invention may use various dimensions, but a side length L of approximately 16 inches has been found convenient for optimizing manufacturing and installation efficiencies. Furthermore, it is desirable to have the length of the sides of the blocks to be such that the division of 96 inches (eight feet) by the length of the block in inches produces an integer. The blocks should be, for example, 12", 16", 24", 32" or 48" in length. This is because a mat that is eight feet wide and forty feet long fits on conventional trailers for transportation. Thus, the blocks should be dimensioned so that when they are assembled into a mat, they can produce a mat of approximately eight feet in width without the need for a special unit or cutting of the units.

Figure 3:
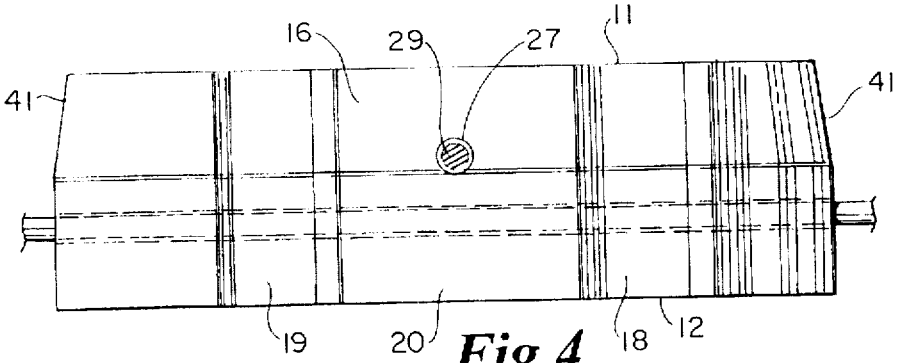
FIG. 3 is a left side view of the revetment block of FIG. 2.
Figure 4:
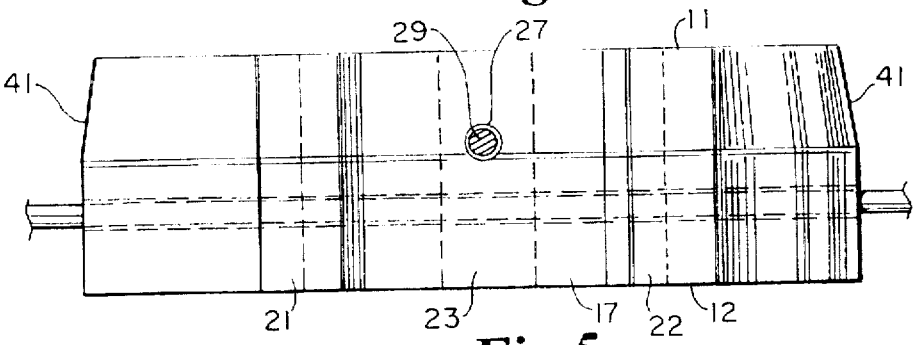
FIG. 4 is a right side view of the revetment block of FIG. 2.
Figure 5:
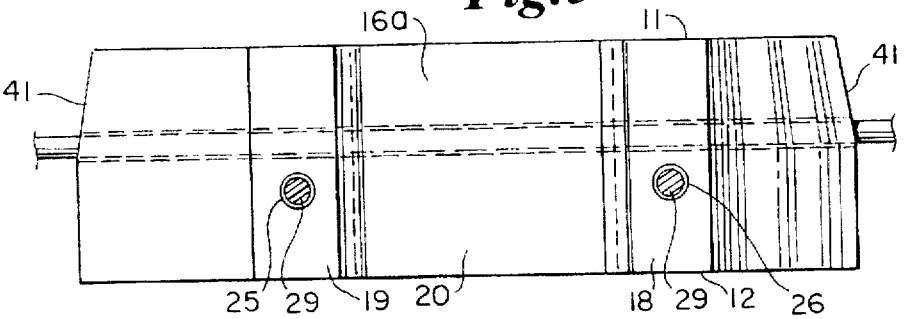
FIG. 5 is a front view of the revetment block of FIG. 2.
Figure 6:
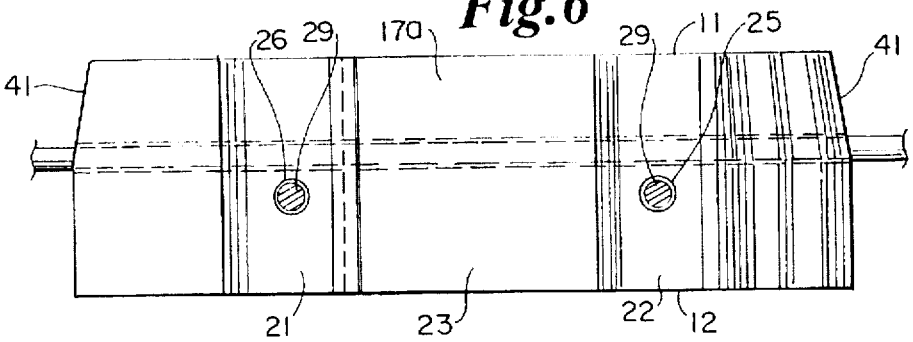
FIG. 6 is a back view of the revetment block of FIG. 2.

The blocks may have tunnels 25, 26, and 27 which penetrate the side surfaces and pass horizontally through the blocks in both directions to allow the blocks to be connected by passing one or more cables 29 through them. These tunnels are also located by reference to the defined square. On at least one of the two pairs of side surfaces, two tunnels penetrate the block between opposed side surfaces, each at the center points of the two recesses and projections. An optional third tunnel may also be provided, preferably located at the midpoint of dimension L to allow additional cabling options. A three tunnel configuration is shown in FIGS. 1, 3 and 4 with respect to side surfaces 16*a* and 17*a*. The other pair of side surfaces has at least one cable tunnel, preferably located such that it penetrates the side surfaces at the midpoint of dimension L, as shown in FIGS. 1, 5 and 6 with respect to side surfaces 16 and 17. Optionally, such other side surface may have two or three tunnels. Such tunnels are positioned at the two center points of the recesses and projections and at the midpoint of dimension L. All of the cable tunnels are located at a height near midway between the top and bottom though the height of the tunnels may vary. Transverse and longitudinal tunnels are located vertically relative to one another such that they do not intersect.

Figure 1B:
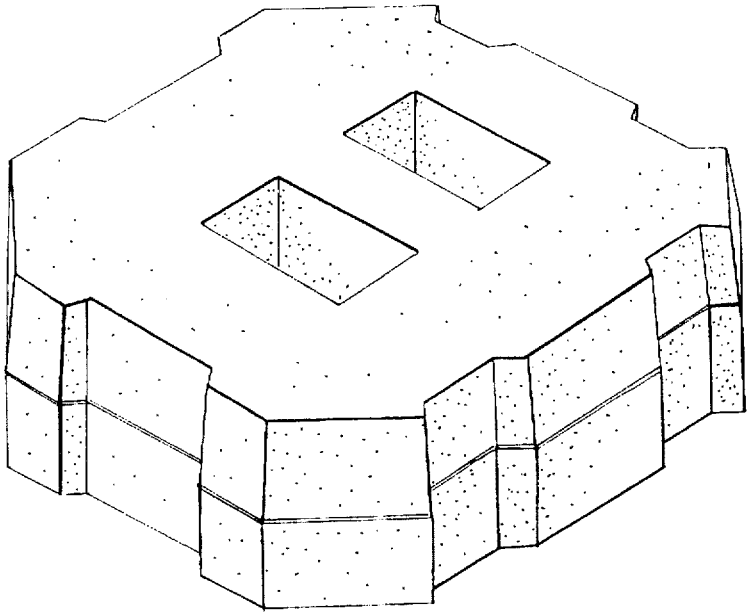
Figure 1C:
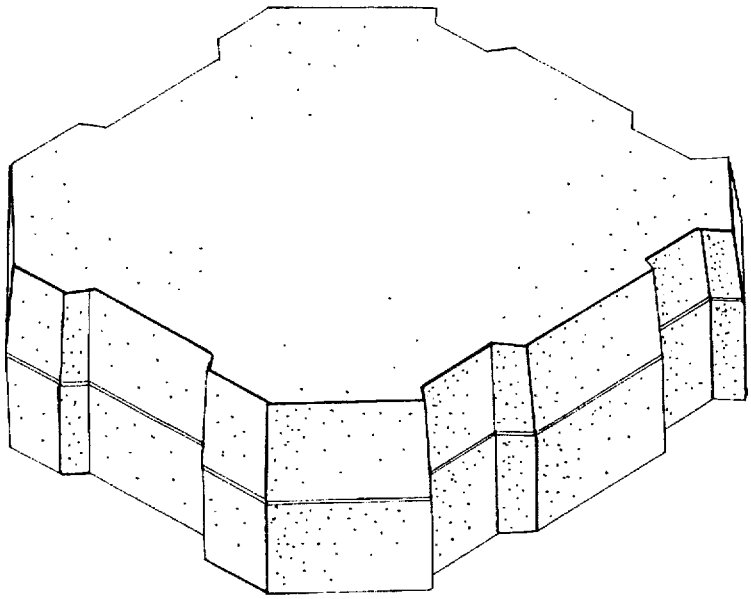
Figure 1D:
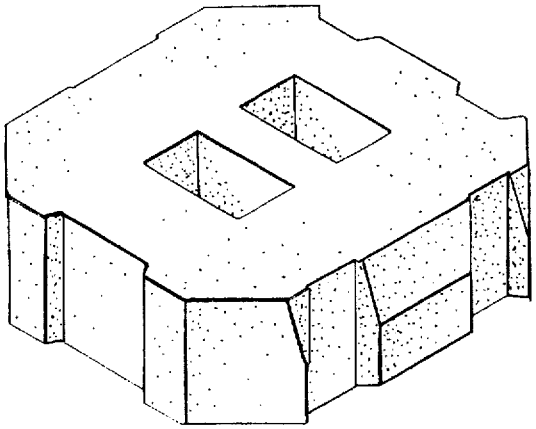

FIGS. 1A, 1B, 1C and 1D show alternate variations for some of the features of the block of FIG. 1. Thus, in FIG. 1A the block has straight sides with no taper 41 as in FIG. 1. In FIG. 1B the block has no tunnels for cabling and would be used in those situations where the blocks are laid in an interlocking matrix but are not connected together with cables. In FIG. 1C the block is solid and is provided with neither tunnels nor voids 40 as in FIG. 1. In FIG. 1D the block has taper 41 on only one of the opposing pairs of sides. These figures illustrate that these features may be present in various combinations or, may be omitted, all within the scope of the present invention.

Figure 7:
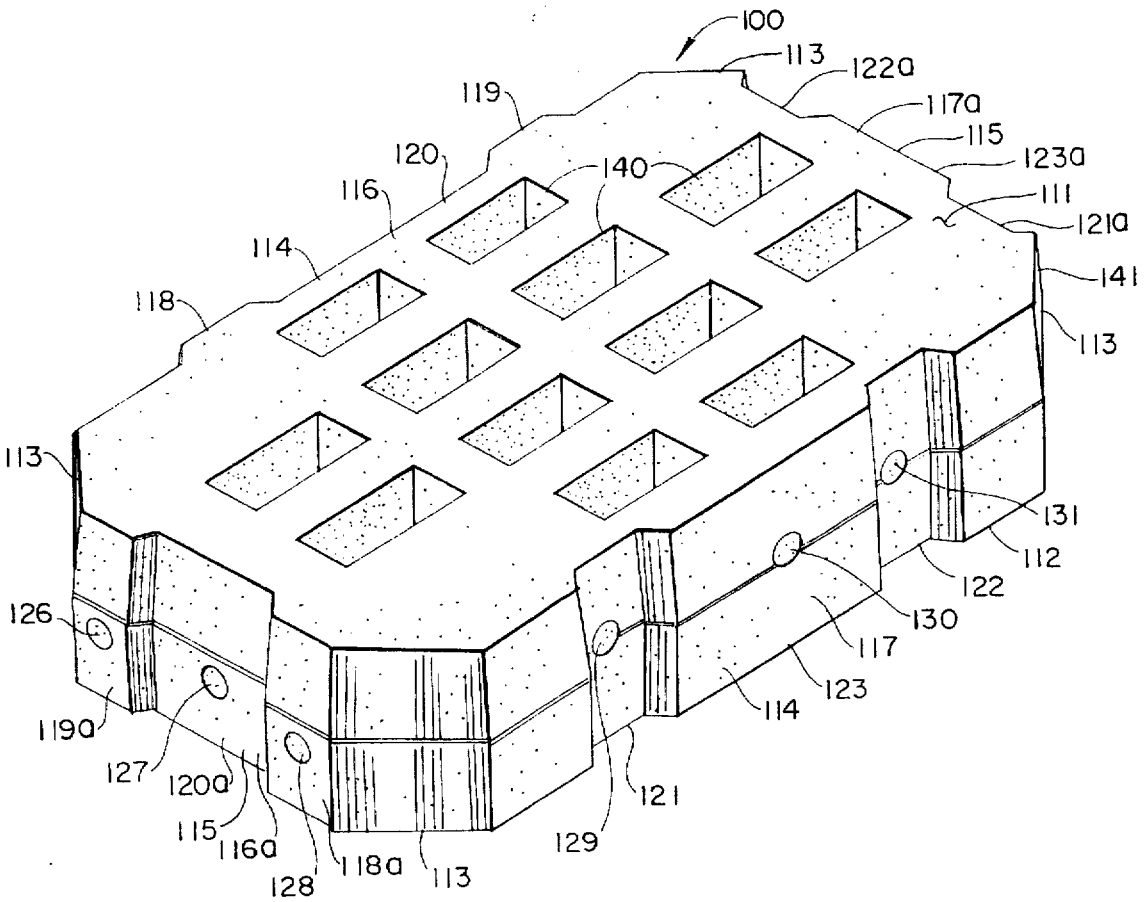
FIG. 7 is a perspective view of a second embodiment of a revetment block according to the present invention.

A second embodiment of a precast concrete block is shown in FIGS. 7, 8, 9, 10, 11 and 12 which are a perspective view, a top view, two side views, and front and back views, respectively. As seen in FIG. 7, block 100 has a substantially planar top surface 111 and bottom surface 112, each being spaced from and parallel to the other. The top surface 111 and bottom surface 112 are both generally rectangular, but may have truncated corners 113. Block 110 has four side surfaces extending from top surface 111 to bottom surface 112 in two pairs of opposed side surfaces 114 and 115. As with the first embodiment shown in FIGS. 1–6, the height of the side surfaces varies depending upon the requirements, typically from four inches to 16 inches. Opposed side surfaces 114 are generally parallel to each other and opposed side surfaces 115 are generally parallel to each other. Opposed side surfaces 114 comprise generally parallel first and second side surfaces 116 and 117. Opposed side surfaces 115 comprise generally parallel third and fourth side surfaces 116*a* and 117*a*. The first side surface 116 has a first projection 118 and a second projection 119. Between first projection 118 and second projection 119 there is a planar central section 120. The second side surface 117 has a first recess 121 and a second recess 122 which are opposed to the first projection 118 and second projection 119, respectively. Between first and second recesses 121 and 122, there is a planar central section 123, which is opposed to and of equal proportions to planar central section 120 of first side surface 116.

Third side surface 116*a* has a shape similar to side surface 116, except that it comprises the shorter side of the rectangular block 100 and the dimensions are, therefore, less. Therefore, third side surface 116*a* has first and second projections 118*a* and 119*a* and central planar section 120*a* similar to side surface 116, however, the overall length of third side surface 116*a* is less than side surface 116 so that the spacing between projections 118 and 119 and central planar section 120 are less. Similarly, fourth side surface 117*a* has a configuration similar to side surface 117, but with smaller dimensions, and has first and second recesses 121*a* and 122*a* and central planar section 123*a*. Block 100 has one or more through holes or voids 140 which are open from top surface 111 through bottom surface 112. Preferably, each of the side surfaces of the block 100 includes a tapered portion 141.

Figure 8:
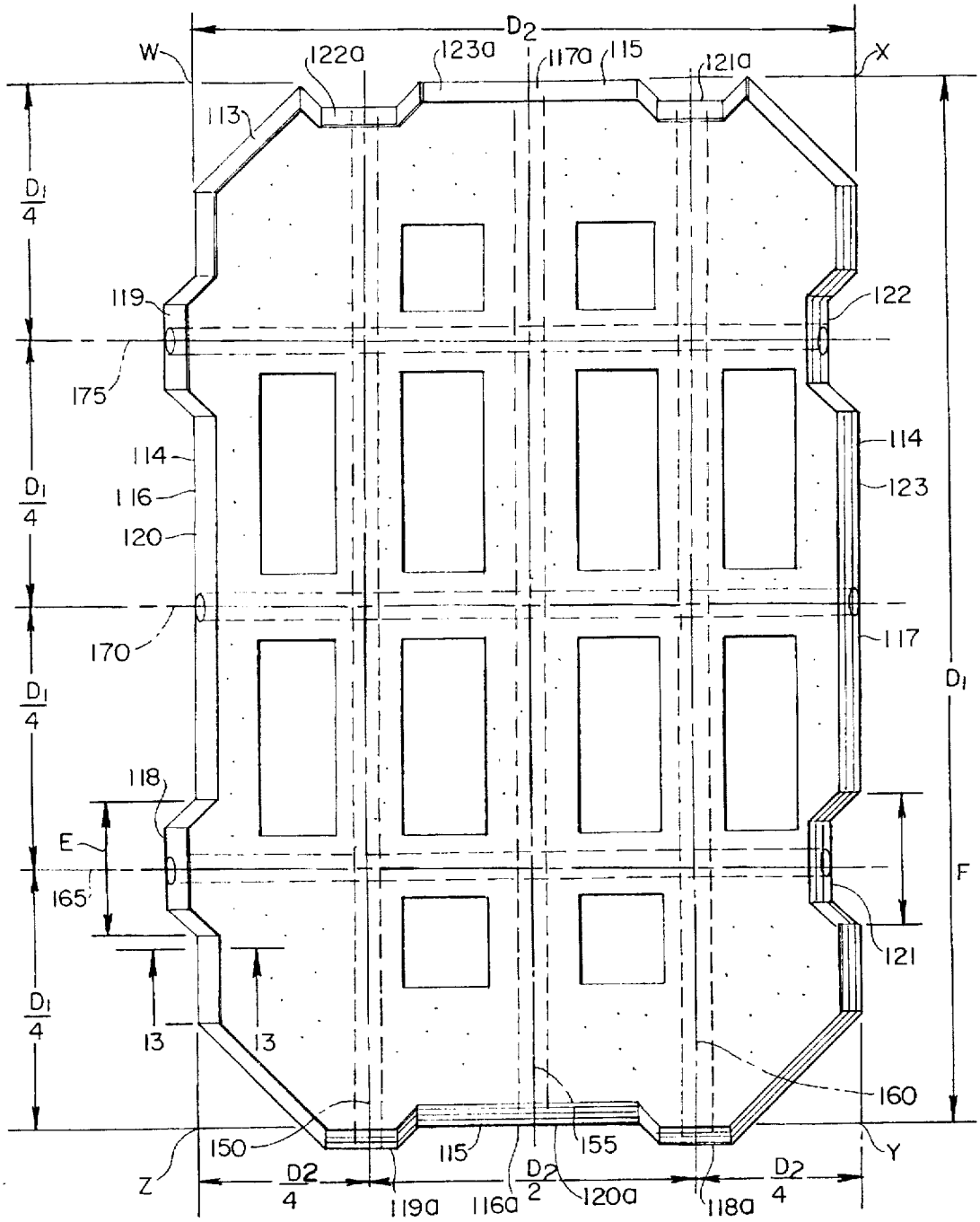
FIG. 8 is a top view of the revetment block of FIG. 7.
Figure 9:
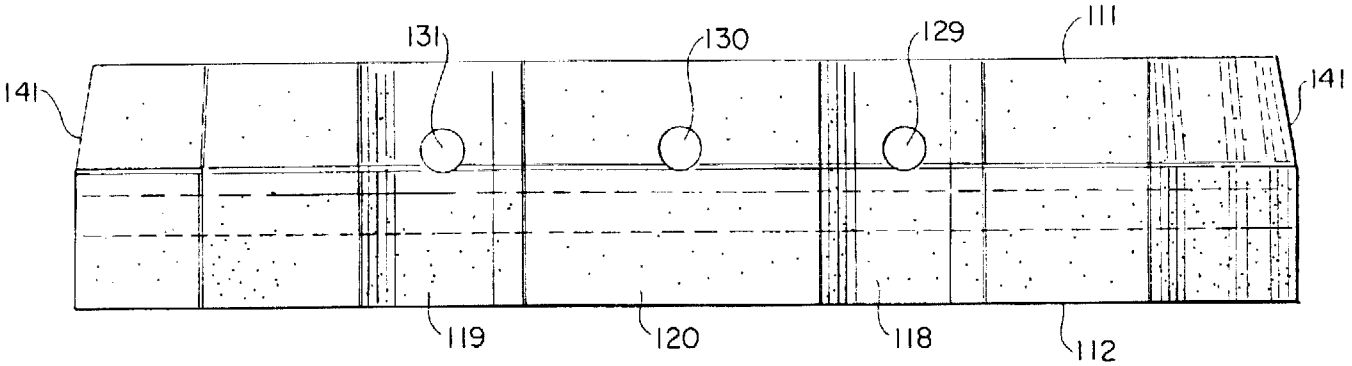
FIG. 9 is a side view of the revetment block of FIG. 1 from the left side of view of FIG. 8.
Figure 10:
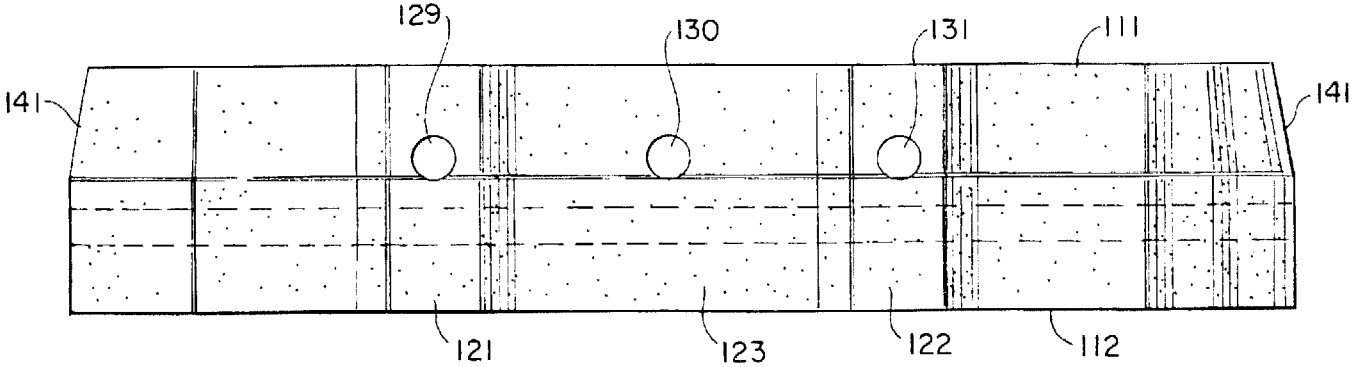
FIG. 10 is a side view of the revetment block of FIG. 1 from the right side of view of FIG. 8.

In this embodiment the recesses and projections are located along the side surfaces by reference to the length of the sides of a rectangle formed by horizontal lines extending from planar central sections 120, 120*a*, 123 and 123A. The rectangle has side dimensions $D_1$ and $D_2$ as shown in FIG. 8. On both pairs of sides 114 and 115 the center point of the first and second projections 118 and 119 and of the first and second recesses 121 and 122 are located one-fourth of the length of either $D_1$ or $D_2$ away from the respective comers (W, X, Y and Z) of the defined rectangle as will be described more fully hereafter. Note that when $D_1=D_2$ the rectangle is a square and the shape of the block is identical to that in FIG. 1. Note also that the overall length E of each projection is equal to the overall length F of each recess. This configuration allows the blocks to be used to construct a revetment mat in either a parallel row and column configuration or an off-set running bond configuration. In either case the projections and recesses of adjacent blocks mate to stabilize the mat.

The recesses 121 and 122 and projections 118 and 119 are oriented vertically and are all of equal proportions. This block provides the same flexibility of configuration options as previously discussed with respect to the first embodiment of FIG. 1. The recesses 121 and 122 and projections 118 and 119 may be curvilinear, angled, u-shaped, v-shaped or otherwise configured so that they are symmetrical around a central vertical plane perpendicular to the side surface and intersecting the horizontal mid point of the recess or projection.

Blocks according to this embodiment may have various dimensions, but a side length $D_1$ of approximately 24 inches and a side length $D_2$ of approximately 16 inches are convenient for optimizing manufacturing and installation efficiencies. As discussed with respect to the first embodiment, it is desirable to have the length of the sides of the blocks be such that the division of 96 inches (eight feet) by the length in inches produces an integer. Thus, the dimensions $D_1$ and $D_2$ should be, for example, 12 inches, 16 inches, 24 inches, 32 inches or 48 inches in length.

As best seen in FIG. 7, block 110 may have tunnels 126, 127 and 128 between opposed side surfaces 115 and may have tunnels 129, 130 and 131 between opposed surfaces 114. These tunnels pass horizontally through the blocks to allow the blocks to be connected by passing a cable through them in both directions. The tunnels are also located by reference to the defined rectangle. Although the embodiments shown have three cable tunnels in each direction, fewer cable tunnels may be used. For example, on at least one of the two pairs of side surfaces, two tunnels should penetrate the block (i.e., tunnels 126 and 128), each at the center points of the two recesses and projections. An optional third tunnel (i.e., tunnel 127) may also be provided, preferably located at the midpoint of dimension $D_2$ to allow additional cabling options. The other pair of side surfaces should have at least one cable tunnel (i.e., tunnel 130), preferably located such that it penetrates the side surfaces at the mid point of dimension $D_1$. Optionally, the other side surface may have additional tunnels, (i.e., tunnels 129 and 131) positioned at the two center points of the recesses and projections. All of the cable tunnels are located at a height near midway between the top and bottom of the block though the height of the tunnels may vary. Transverse and longitudinal tunnels are located vertically relative to one another such that they do not intersect.

The position of the recesses, projections, central planar sections and cable tunnels can be explained with respect to FIG. 8. The defined rectangle has sides of length $D_1$ and $D_2$ meeting at comers W, X, Y and Z. In this configuration the center lines 150, 155 and 160 of cable tunnels 126, 127 and 128, running between opposed side surfaces 115, lie along generally vertical planes which are parallel to opposed side surfaces 114 and perpendicular to opposed side surfaces 115 and top and bottom surfaces 111 and 112. Likewise, center lines 165, 170 and 175 of cable tunnels 129, 130 and 131, running between opposed side surfaces 114, lie generally along vertical planes which are parallel to opposed side surfaces 115 and perpendicular to opposed side surfaces 114 and top and bottom surfaces 111 and 112. Each of the generally vertical planes divides the defined rectangle into fourths such that, for example, the plane along which center line 150 lies is located $D_2/4$ from comers W and Z at the place where it intersects the sides of the rectangle defined by sides 117*a* and 116*a*, respectively. Similarly, the center points of each of the recesses (121, 122, 121*a*, 122*a*), projections (118, 119, 118*a*, 119*a*) and central planar sections (120, 123, 120*a*, 123*a*) lie along one of these planes. Thus, for example, the center points of projection 119 and recess 122 lie along the same vertical plane along which centerline 175 lies and the center points of central planar sections 120*a* and 123*a* lie along the same vertical plane along which center line 155 lies.

Figure 13A:
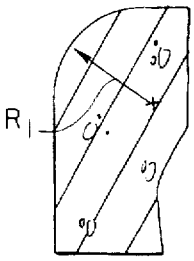
FIGS. 13A, 13B and 13C show alternate taper variations which may be used with the block of FIG. 8 as shown along section line 13—13.
Figure 12:
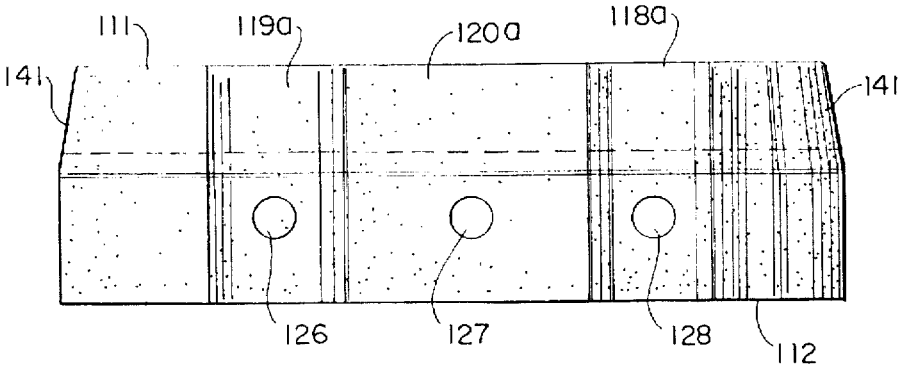
FIG. 12 is a back view of the revetment block of FIG. 8.
Figure 13B:
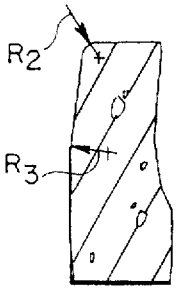
Figure 11:
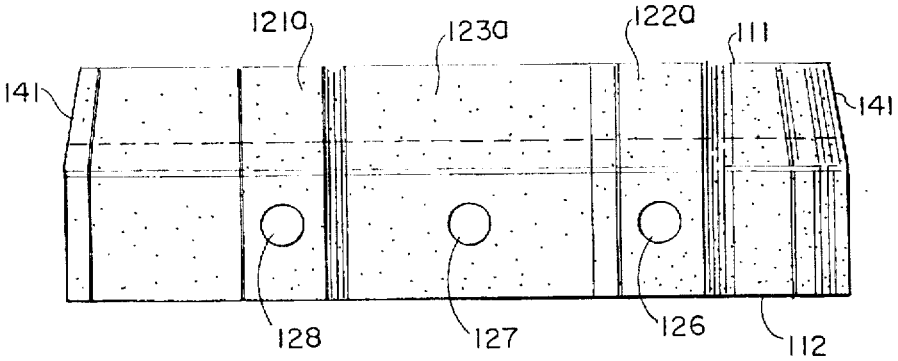
FIG. 11 is a front view of the revetment block of FIG. 8.
Figure 13C:
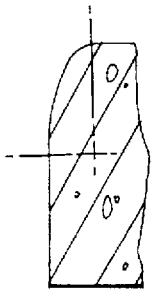
Figure 14A:
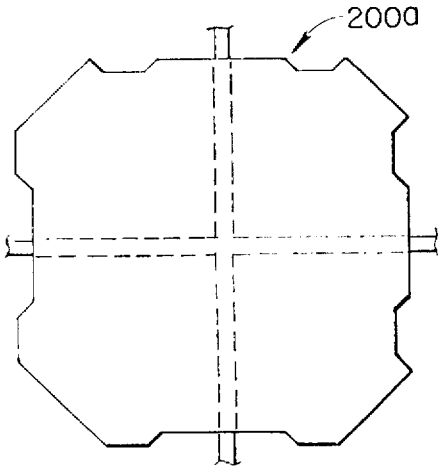
FIGS. 14A, 14B, 14C, 14D, 14E, and 14F are top plan views of alternate tunnel configurations of revetment blocks similar to that of FIG. 1.
Figure 14B:
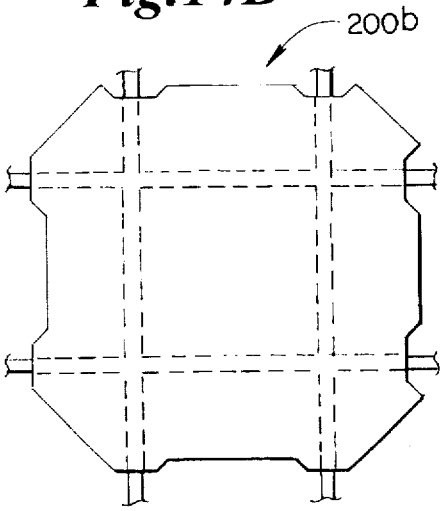
Figure 14C:
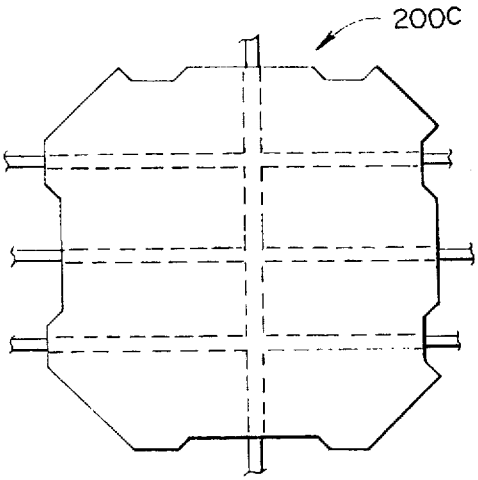
Figure 14D:
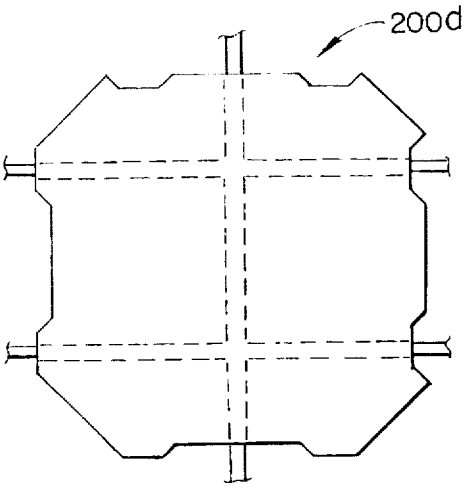
Figure 14F:
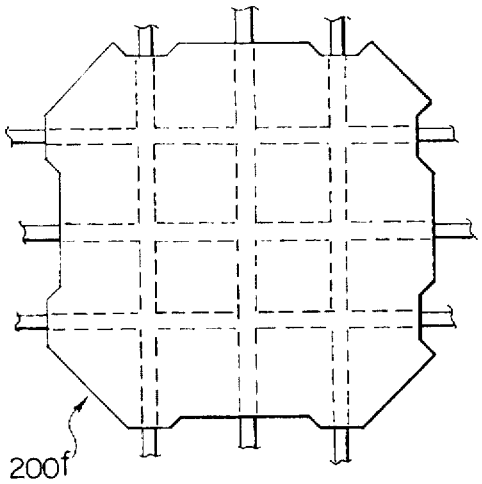
Figure 14E:
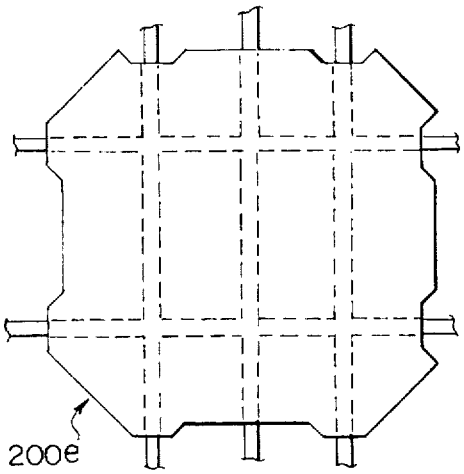

As mentioned above in connection with FIG. 1A, the blocks of the present invention may have sides which do not taper. Alternatively, they may have at least one pair of tapered side surfaces and, preferably, have both pairs of side surfaces tapered. FIGS. 13A, 13B and 13C show alternative configurations for the tapered side portions of the side surfaces as shown in section 13—13 of FIG. 8. As previously mentioned, the tapered portions of the side surfaces are provided in order to allow the assembled revetment mat to articulate when placed over non-planar surfaces or when the mat is lifted with the spreader bar. However, some breakage of blocks may occur due to excessive loads which may be present at the corner between the vertical portion and the angled portion of the side wall. The variations shown in FIGS. 13A, 13B and 13C eliminate the sharp angles by providing a curved transition from the horizontal top surface 111 to the vertical portion 142 of the side surface. By curving the transitional area 141 stress at the corners can be reduced. The curved transition area may be comprised of a single radius $R_1$ as in FIG. 13A multiple radii $R_2$, $R_3$ as in FIG. 13B, or consist of a logarithmic curve as in FIG. 13C.

Cabling Options-Universal Block

FIGS. 14A, 14B, 14C, 14D, 14E and 14F show various dual cable configurations for revetment blocks 200*a*–200*f*. The configurations range from a system with one cable in the longitudinal direction and one cable in the transverse direction as in FIG. 14A, to the block of FIG. 14F, with three cables in both the longitudinal and transverse directions. Note that the blocks may be manufactured with only the tunnels necessary to accommodate the desired number of cables or, alternatively, a universal block with three cable tunnels in each the longitudinal and transverse directions may be used. In that case, any of the cable configurations shown in FIGS. 14A–14F may be accommodated by use of a single universal block. Note also that although a square block is shown for purposes of illustration, each of the cable configurations are equally applicable for use with rectangular blocks such as that shown in FIGS. 7–12.

These multiple cable configurations allow the user to tie the blocks together in a manner which is suitable for the particular application and the desires of the user. For example, in applications where the hydraulic forces caused by flowing water are high, it will be desirable to use a multiple cable system such as that shown in FIG. 14F. In others, where the forces are lower, a more cost-effective system such as that of FIG. 14A may be desirable. The universal block of the present invention allows maximum design flexibility since the same block may be used for all applications.

Through Hole Configurations

FIGS. 15A, 15B, 15C, and 15D show various alternative configurations for the through holes or voids which run from the top surface of the revetment blocks through the bottom surface. The orientation and configuration of the voids is important from the stand point of the hydraulic efficiency of the block. The voids are provided to allow for the release of hydrostatic pressure from beneath the revetment structure and to allow a plantable area such that vegetation can be introduced to the areas of the structures that are above the normal water line.

One of the problems with conventional revetment blocks is that the through holes may be affected by the forces of waves or flowing water. These forces may cause shifting of the revetment mat or may result in stressing portions of the revetment mat leading to eventual failure. The through hole configurations of FIGS. 15A–15D are configured to reduce the adverse effects of these stresses.

Figure 15A:
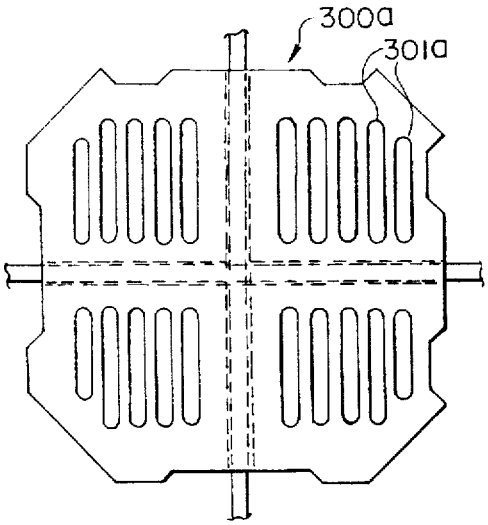
FIGS. 15A, 15B, 15C, and 15D are alternate configurations of slotted voids in the revetment block of the present invention.
Figure 15B:
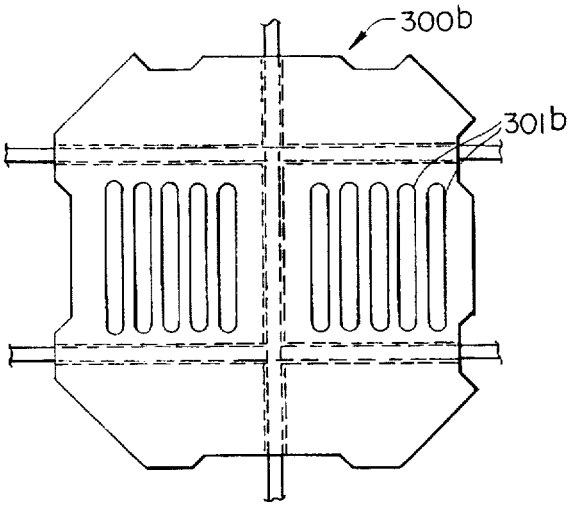
Figure 15C:
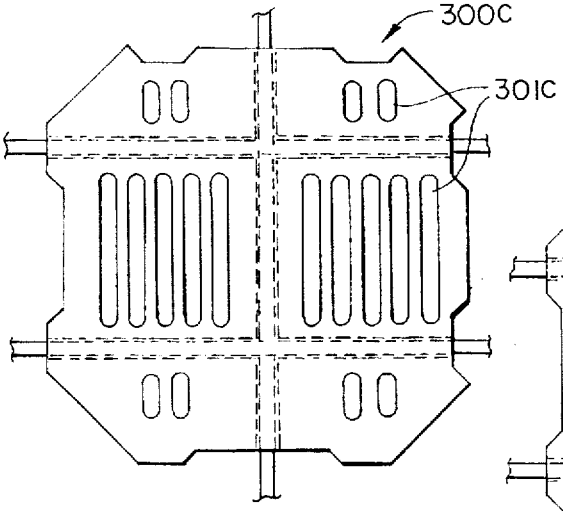
Figure 15D:
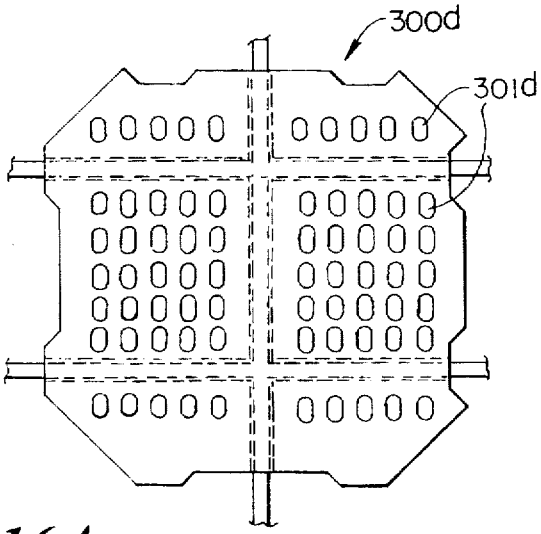

In FIGS. 15A, 15B, and 15C blocks 300*a*, 300*b* and 300*c* have multiple through holes in the shape of elongated slots 301*a*, 301*b* and 301*c*. The elongated slots are configured to provide the desired open void area (approximately 20%) when assembled in a mat. The elongated shape reduces the adverse effects of hydraulic forces when the mats are assembled and positioned such that the elongated slots are parallel with the direction of water flow. Similarly, in FIG. 15D block 300*d* has holes 301*d* oriented in a linear array. The linear orientation acts in a manner similar to the elongated slots and reduces the adverse effects of hydraulic forces when the lines of holes are oriented in a direction parallel with the direction of water flow. Although the holes are shown in FIG. 15D as being slightly elongated, it will be appreciated that the holes could have other shapes including round. See, for example, FIG. 16D.

As will be discussed more fully hereafter, the blocks of the present invention may be assembled into mats so that the elongated slots may be oriented in either a transverse or longitudinal direction to suit individual job requirements. For example, along a river bank the flow of water is generally parallel to the shoreline. Therefore, it is desirable to align the slots in a direction which is also parallel to the shoreline and to the flow of water. Conversely, on the shore of an ocean, lake or other non-flowing body of water, the motion of the water is generally transverse or perpendicular to the shoreline. Therefore, in that situation it is desirable to align the slots in a direction which is also transverse or perpendicular to the shoreline and parallel to the water motion.

Assembly of Revetment Mats

The revetment blocks of the present invention may be assembled into a mat off-site, usually at a block precasting facility. Alternatively, the blocks may be positioned at the job site and then connected together by cables on-site. The revetment mats comprise an interconnected matrix of blocks which may be cabled together using any of the cabling alternatives discussed above, although, for some applications, no cables are needed. The mats are typically rectangular having opposing ends and opposing longitudinal sides. A typical dimension is 8 feet by 40 feet, although there is considerable design flexibility and the mats can be assembled in any desired dimension, depending on block size.

Figure 16C:
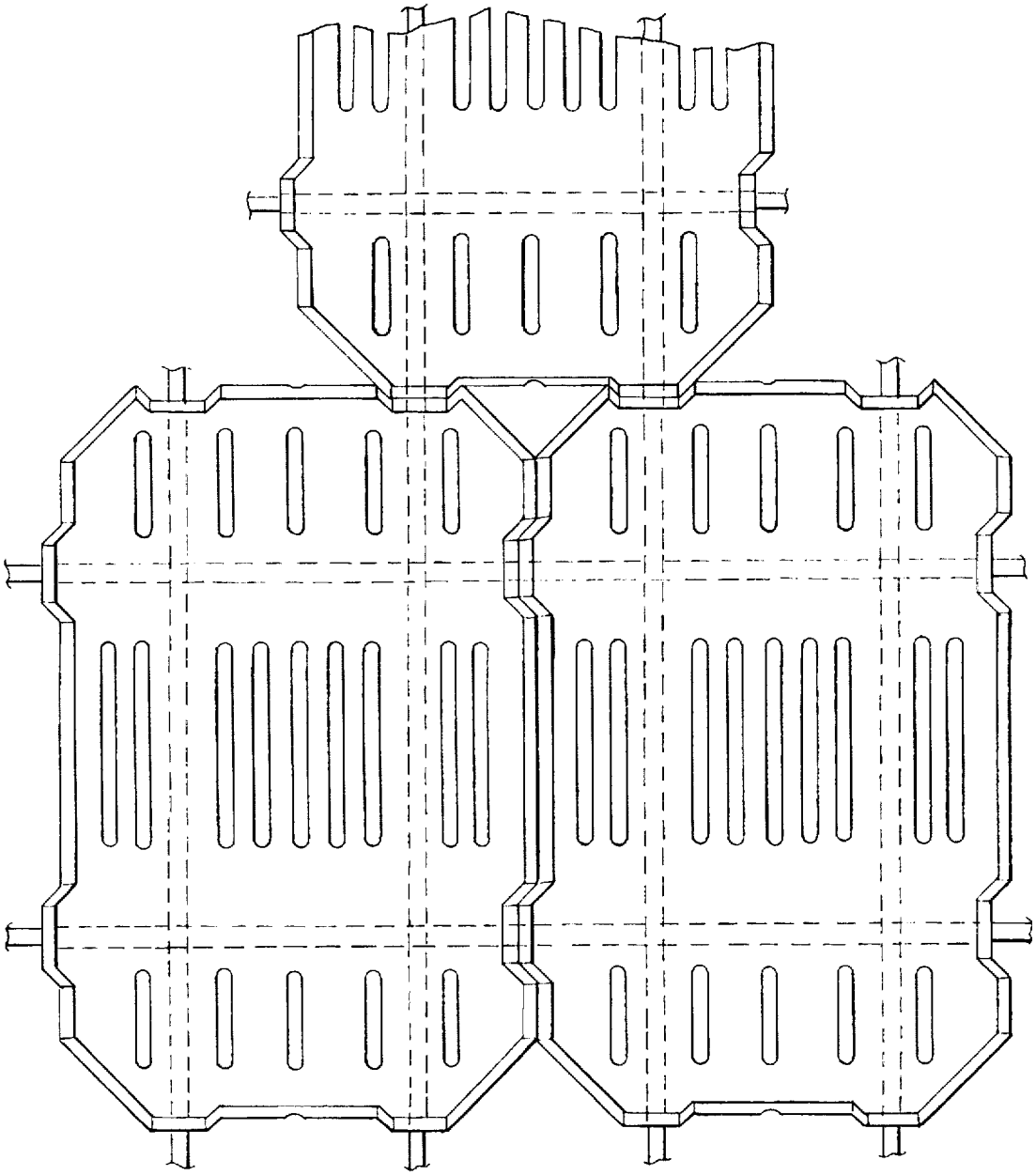
FIGS. 16A, 16B, 16C, 16D, and 16E show alternate interlock combinations of revetment blocks according to the present invention.
Figure 16A:
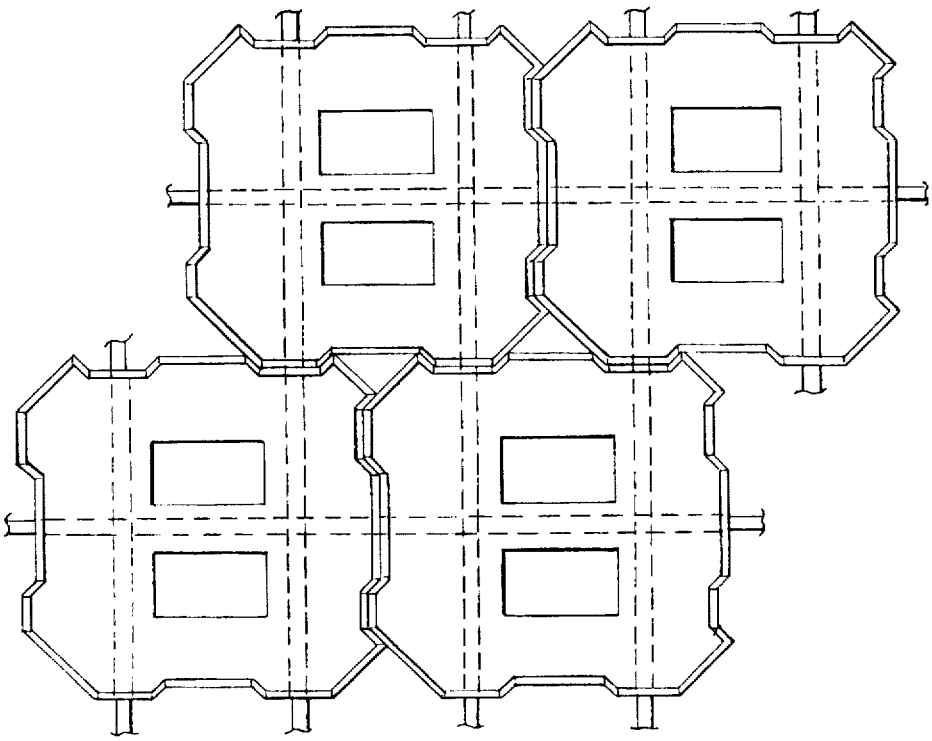
Figure 16B:
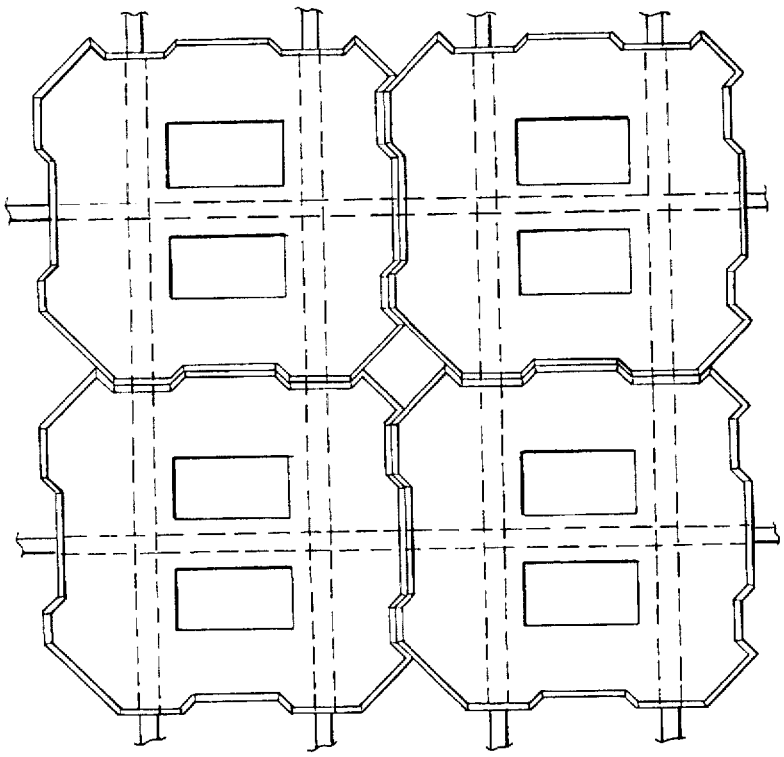
Figure 16D:
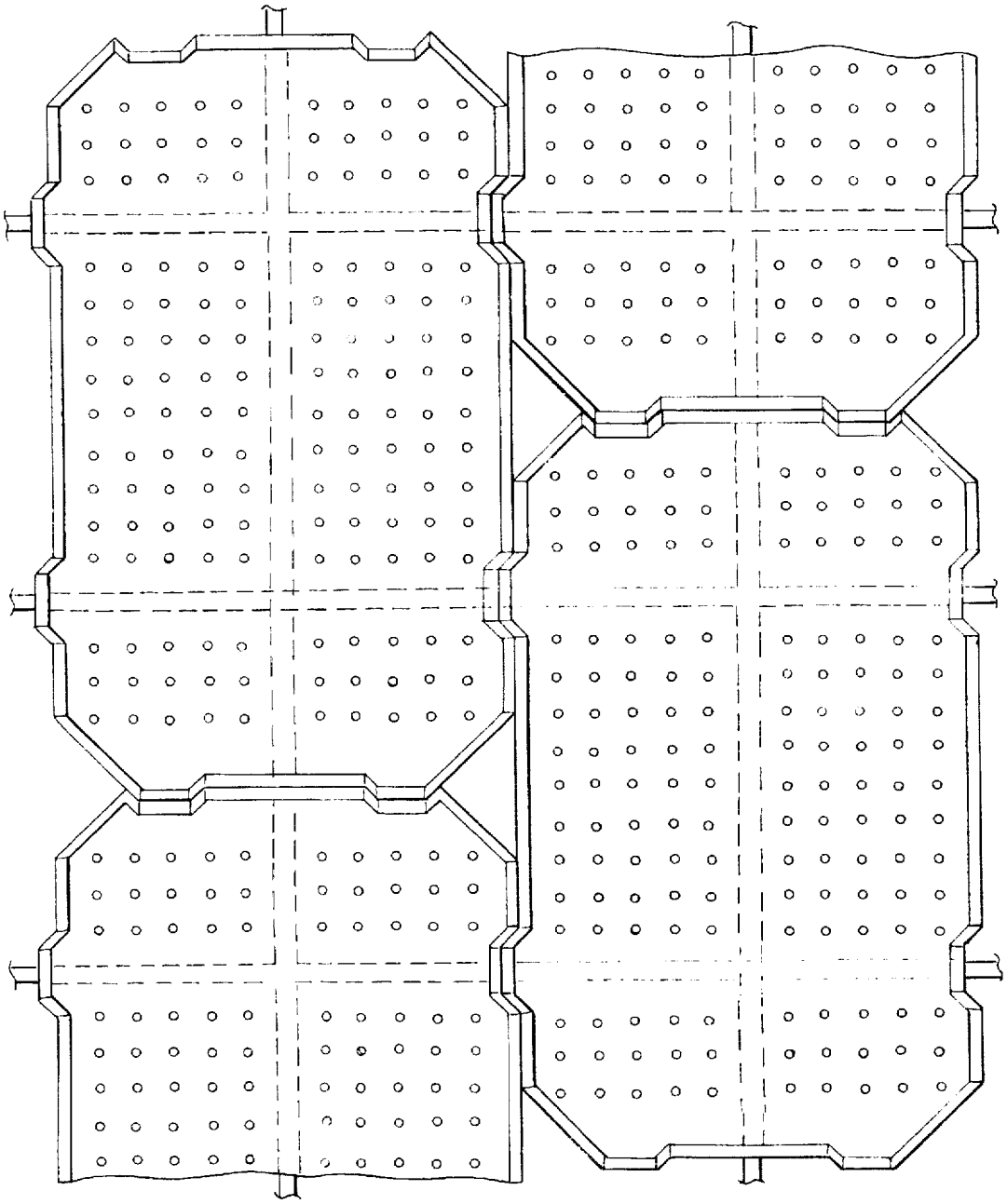
Figure 16E:
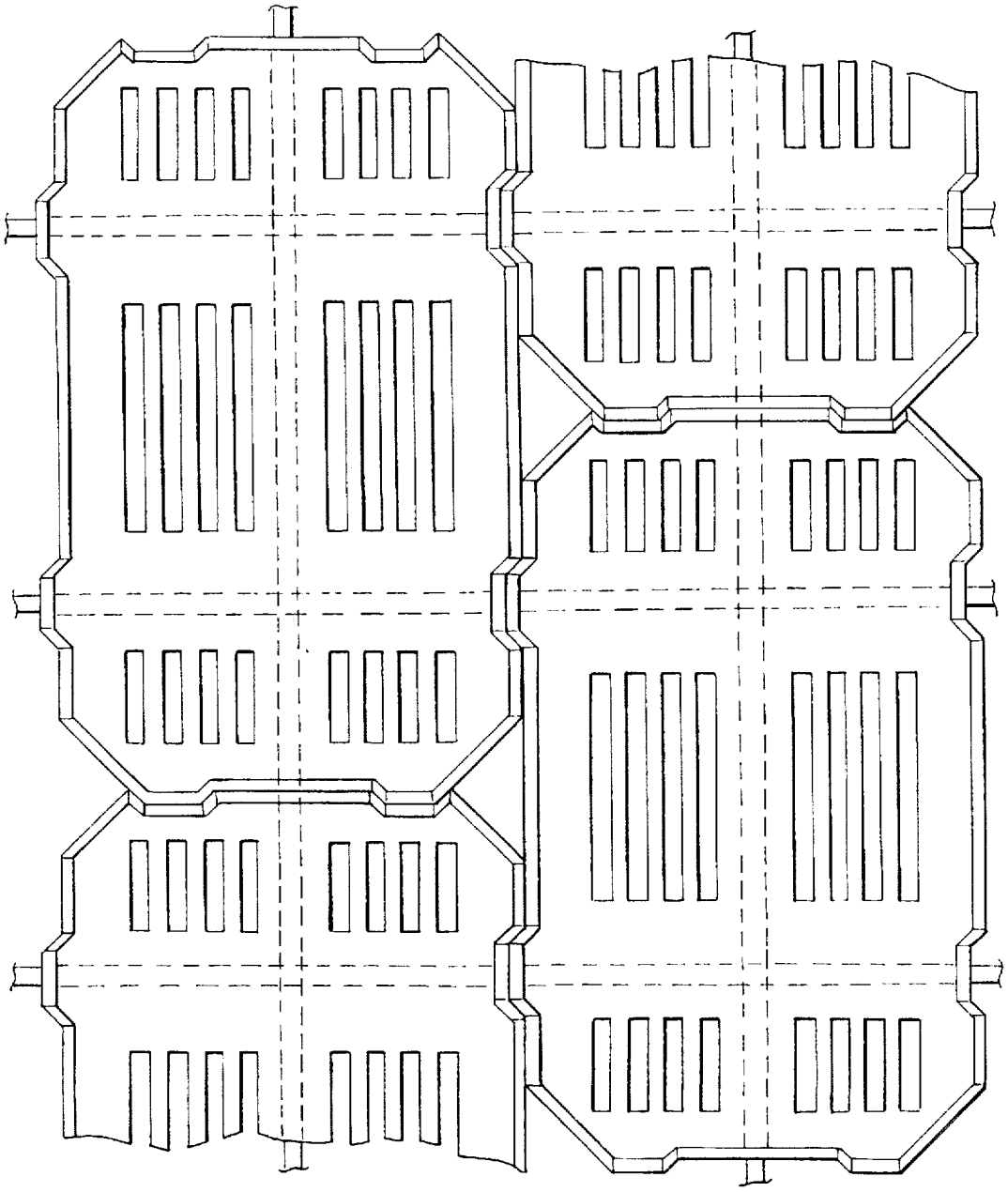

FIGS. 16A, 16B, 16C, 16D and 16E show portions of revetment mats and illustrate several examples of differing ways the mats can be assembled. FIG. 16A shows generally square revetment blocks connected together in a dual cable system using an off-set or running bond pattern. In this configuration, blocks in each row are aligned so that the projections on the side wall facing adjacent blocks in the row mate with the recesses of adjacent blocks in the row. However, since the blocks in the columns are off-set, the projections of side walls adjacent blocks in the column mate with the recesses of two blocks. Thus, even though the blocks are off-set, the interlocking surface area is maintained and the structural integrity of the mat is preserved. FIG. 16B shows the same style revetment blocks connected together by cabling in a parallel row and column configuration. In the configuration projections of side surfaces mate with recesses in blocks in adjacent rows and columns, with no off-set. FIG. 16C shows rectangular revetment blocks connected together in a running bond pattern along the short side of the rectangle. FIG. 16D and 16E show generally rectangular revetment blocks with different void configurations connected together in a running bond pattern off-set along the longer dimension of the rectangle.

Figure 17A:
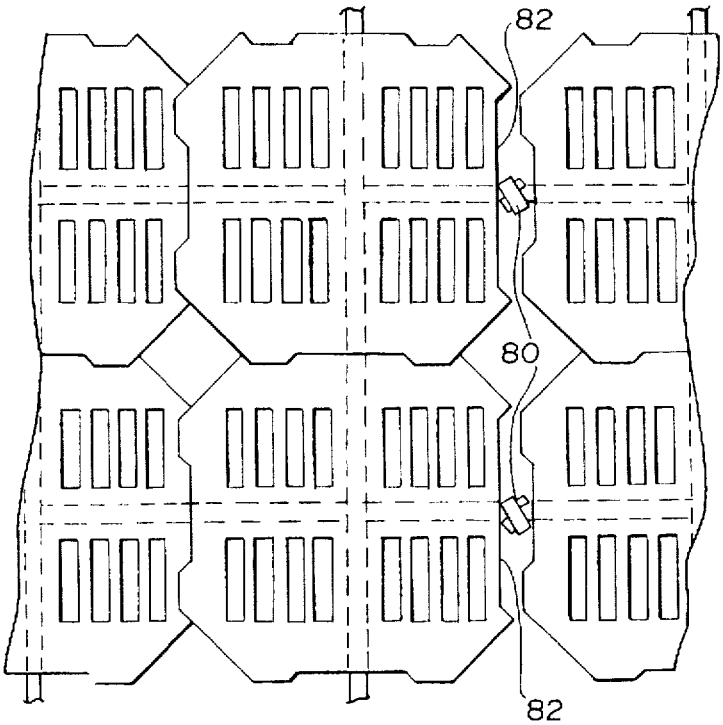
FIGS. 17A and 17B are partial views of revetment mats connected with the revetment blocks in a first orientation and in a second orientation rotated 90° from the first orientation.
Figure 17B:
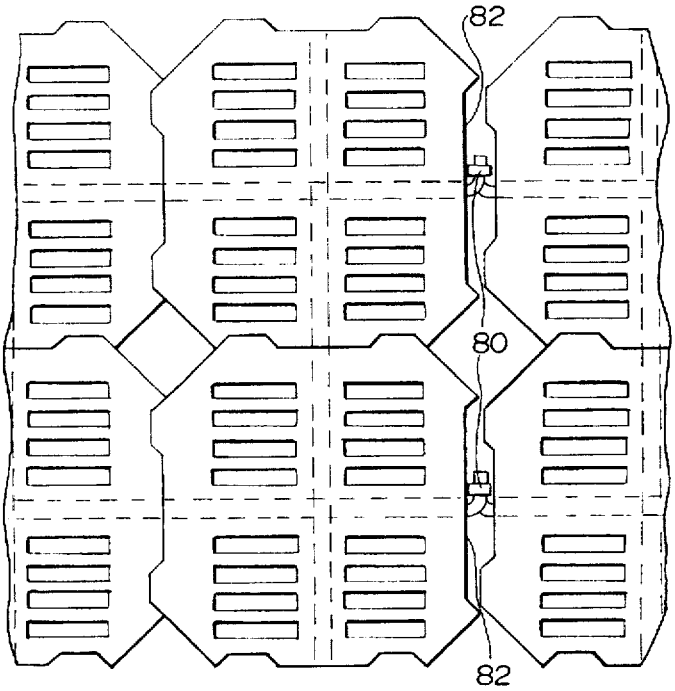

FIGS. 17A, 17B, 18A and 18B illustrate the method of connection between adjacent revetment mats in both parallel row and column configurations and in off-set or running bond pattern configurations. These figures also illustrate the manner in which the same blocks, with elongate slot configurations, can be oriented in different manners in order to align the slots in the direction of water flow. In FIG. 17A square revetment blocks are used. The revetment blocks have longitudinal slots which are oriented generally parallel with the longitudinal sides of the revetment mat and perpendicular to the ends of the mat. In use, the mats are connected by crimping the exposed ends of the cables along the sides of each mat together, typically with an aluminum sleeve 80. FIG. 17B shows a revetment system comprised of mats utilizing the same type of square revetment blocks. However, in FIG. 17B the blocks have been rotated 90° such that the longitudinal slots are generally perpendicular to the longitudinal sides of the revetment mat and parallel to the ends of the mat. This illustrates the ability of the present invention to allow revetment blocks to be positioned to allow the slots to be aligned in the direction of the forces of the water. As shown in FIGS. 17A and 17B, a slightly modified block may be used along a lateral edge of a revetment mat which is to be connected to an adjacent mat. In the modified block the central planar projection on one side is omitted thus forming a generally indented surface 82. This allows more room during connection of adjacent mats for accessing the ends of the cables in order to crimp them. It also allows adjacent connected mats to be placed closer together.

Figure 18A:
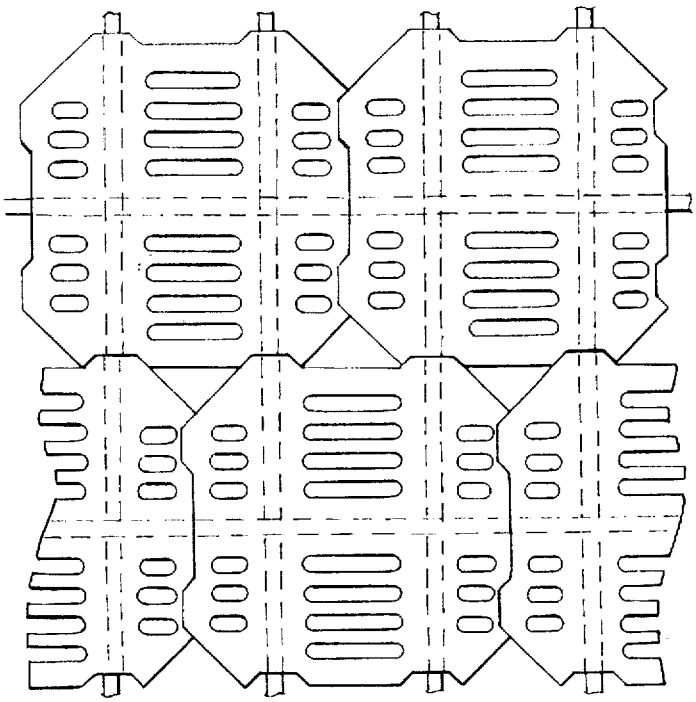
FIGS. 18A and 18B are portions of two revetment grids connected together in a running bond pattern.
Figure 18B:
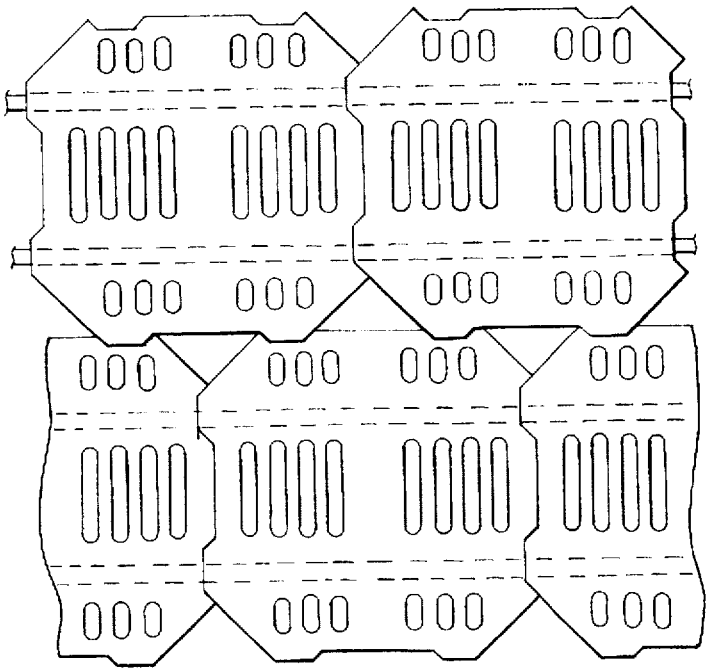

FIGS. 18A and 18B also illustrate the connection between adjacent mats. The mats are formed by square revetment blocks off-set with respect to one another in a running bond.

In FIG. 18A the blocks are positioned so that longitudinal slots in the blocks are generally perpendicular to the longitudinal sides of the mat and parallel to the ends of the mat. In FIG. 18B the blocks are positioned so that longitudinal slots in the blocks are generally parallel with the longitudinal sides of the mat and perpendicular to the ends of the mat.

Alternate Bottom Surface Configurations

Figure 19A:
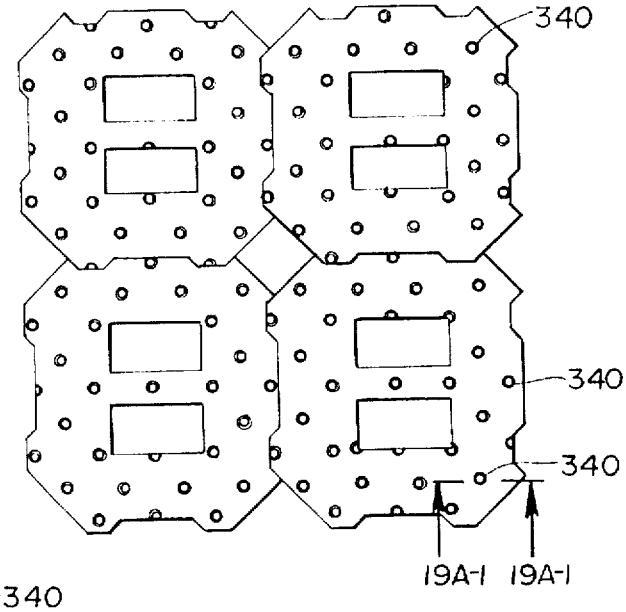
FIGS. 19A and 19B are perspective views of the bottom of revetment blocks in accordance with the present invention with alternate bottom surface configurations to increase frictional stability of the revetment.
Figures 1, 19A:
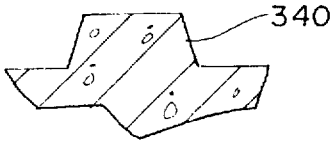
Figure 19B:
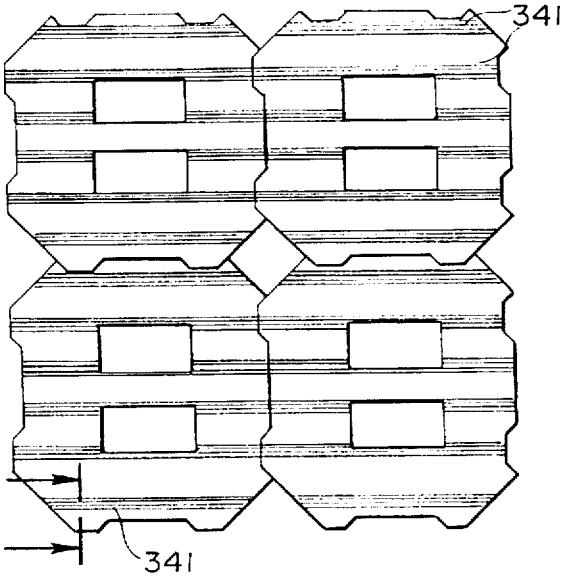
Figures 1, 19B:
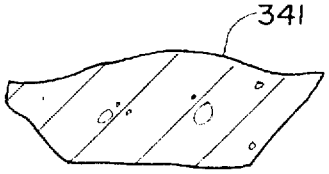

The present invention includes several alternatives directed to increasing the shear resistance of the interface of the block with the geofabric and soil substrate. FIGS. 19A and 19B show alternative bottom surface embodiments which improve the shear resistance of the block. As best seen in FIG. 19A-1, which is a partial sectional view along line 19A—19A of FIG. 19A, the bottom surface of the blocks of FIG. 19A are provided with projections in the shape of truncated cones 340 which extend from the bottom surface. The projections increase the shear resistance of the block and geofabric against lateral displacement along the soil interface. FIG. 19B-1 is a similar view taken along line 19B—19B of FIG. 19B and shows a revetment block with projections in the shape of ridges 341 along the bottom surface. The ridges, like the projections of FIG. 19A, increase the shear resistance of the geofabric and block against lateral displacement along the soil.

Figure 21:
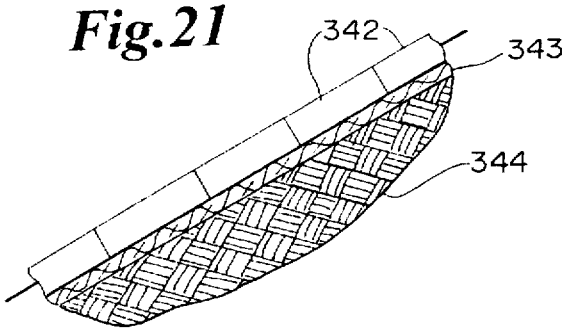
FIG. 21 is a partial side view of a revetment system in accordance with one aspect of the present invention.

A revetment system utilizing these projections to increase stability is shown in FIG. 21 which is a partial side view of the system in place over a soil substrate to control erosion. Revetment mat 342 is placed over a fabric sheet 343 which covers the soil substrate 344. Projections similar to those discussed above (not shown) protrude into the fabric sheet from the bottom surface of the individual blocks which comprise the mat. The projections increase the shear resistance of the system allowing it to remain in proper position even though substantial shear forces may exist at the interface of the system with the soil substrate due to forces of water and gravity.

Cable Tunnel Sleeve

Figure 20:
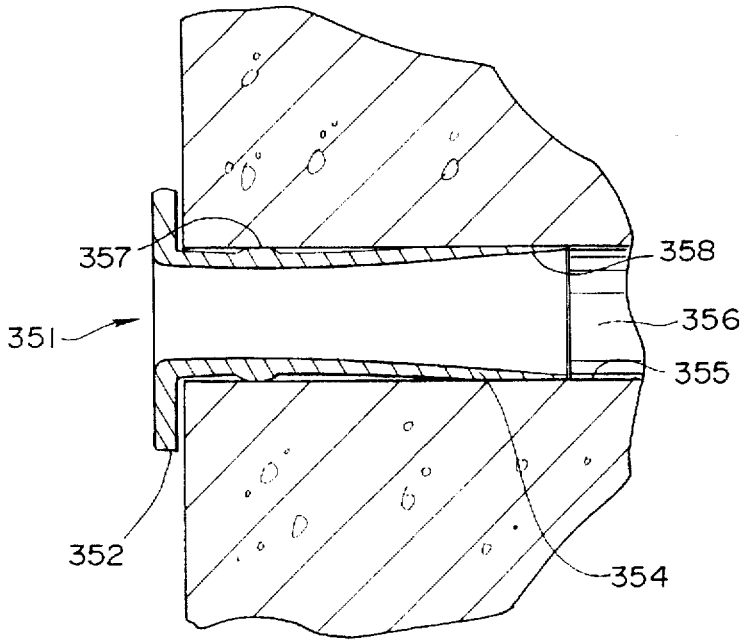
FIG. 20 is a partial sectional view of a tunnel with a protective sleeve.

FIG. 20 is a partial sectional view of a cable tunnel utilizing a sleeve insert 351. Sleeve insert 351 has a circumferential lip 352 and a generally cylindrical body portion 353. Body portion 353 has an exterior surface 354 which is in contact with and frictionally engages the exterior surface 355 of tunnel 356. Preferably, body portion 353 is provided with frictional projections 357 to create a tight and secure frictional fit with tunnel 356. Projections 357 may be circular, longitudinal, transverse or of any other desired configuration. The sleeve is inserted into each end of each tunnel which is to receive a cable. The inserts may be comprised of a rigid material such as metal, polyvinyl chloride, polyurethane, nylon or plastic. The sleeves serve to protect the cable from abrasion and consequent breakage which tends to occur in areas where the cable exits the tunnels. The sleeve may be sized so that it is inserted into the tunnel at each end of the block for a distance of at least ¾ inch and no more than half the length of the tunnel. Circumferential lip 352 is configured larger than tunnel 356 so that it engages the side surface into which the sleeve is inserted to limit the distance which the sleeve may be inserted into the tunnel. Preferably, the inner surface 358 of the sleeve is tapered towards the interior surface of the tunnel to allow the cable to be inserted without hanging up on the end of the sleeve.

I claim:

1. A block for use in a revetment system which includes a plurality of blocks arranged to form a mat, the block comprising:

a top surface;

a bottom surface; and first and second opposed and substantially parallel side surfaces extending between the top and bottom surfaces, and third and fourth opposed and substantially parallel side surfaces extending between the top and bottom surfaces and the first and second side surfaces, the first and third side surfaces each having first and second projections and the second and fourth side surfaces each having first and second recesses, the projections and recesses being sized and configured such that the projections on the first and third side surfaces mate with the recesses on the second and fourth side surfaces, respectively, of an adjacent block in the mat.

2. The block of claim 1 further comprising a tunnel extending between one of the first and second opposed side surfaces and the third and fourth opposed side surfaces to enable the block to be connected to other blocks in the mat.

3. The block of claim 1 wherein the first and second side surfaces include a portion which is tapered inwardly towards the top surface such that the area of the top surface is less than the area of the bottom surface.

4. The block of claim 3 wherein the third and fourth side surfaces include a portion which is tapered inwardly towards the top surface.

5. The block of claim 3 wherein the tapered portion comprises one of a curve having a single radius, a curve having multiple radii and a logarithmic curve.

6. The block of claim 4 wherein the tapered portion comprises one of a curve having a single radius, a curve having multiple radii and a logarithmic curve.

7. The block of claim 1 wherein the recesses and projections extend vertically between the top and bottom surfaces.

8. The block of claim 1 wherein the side surfaces intersect to form corners and wherein each of the corners is truncated between the top and bottom surfaces.

9. The block of claim 1 further including at least one opening between the top and bottom surfaces.

10. The block of claim 9 wherein the at least one opening is shaped in the form of an elongate slot.

11. The block of claim 9 wherein the at least one opening comprises lines of linearly positioned holes arranged in a linear array.

12. The block of claim 10 wherein the elongate slot is parallel to the first and second side surfaces and perpendicular to the third and fourth side surfaces.

13. The block of claim 10 wherein the elongate slot is parallel to the third and fourth side surfaces and perpendicular to the first and second side surfaces.

14. The block of claim 11 wherein the lines of holes are parallel to the first and second side surfaces and perpendicular to the third and fourth side surfaces.

15. The block of claim 11 wherein the lines of holes are parallel to the third and fourth side surfaces and perpendicular to the first and second side surfaces.

16. The block of claim 1 further including at least one tunnel extending between the first and second opposed side surfaces.

17. The block of claim 1 further including a plurality of tunnels including at least one tunnel extending between the first and second opposed side surfaces and at least one tunnel extending between the third and fourth opposed side surfaces.

18. The block of claim 17 wherein the plurality of tunnels includes a plurality of tunnels extending between the first and second opposed side surfaces and a plurality of tunnels extending between the third and fourth opposed side surfaces.

19. The block of claim 1 further including a sleeve positioned in the tunnel, the sleeve extending from one of the side surfaces for a distance not exceeding one-half of the distance to the opposing side surface.

20. The block of claim 19 wherein the sleeve is provided with a projection which frictionally engages with an interior surface of the tunnel to secure the sleeve within the tunnel.

21. The block of claim 19 wherein the sleeve comprises an inner surface and an outer surface and wherein the inner surface is tapered towards the outer surface in a direction opposite the side surface.

22. The block of claim 19 wherein the above sleeve further comprises a circumferential lip configured to engage the side surface and limit the distance which the sleeve extends into the tunnel.

23. The block of claim 1 wherein the bottom surface is provided with a plurality of projections to enhance the frictional stability of the block.

24. The block of claim 23 wherein the projections are in the shape of cones.

25. The block of claim 23 wherein the projections are in the shape of elongate ridges.

26. The block of claim 1 wherein the top and bottom surfaces are substantially planar and parallel to one another and wherein the first and third side surfaces include substantially planar central sections extending between the first and second projections and the top and bottom surfaces, and the second and fourth side surfaces have substantially planar central sections extending between the first and second recesses and the top and bottom surfaces, the central planar sections being configured such that lines which extend along edges formed by intersections of the central planar sections and a central plane substantially parallel with and lying between the top and bottom surfaces intersect to form a rectangle.

27. The block of claim 26 wherein the rectangle is a square.

28. The block of claim 26 wherein the rectangle has a first pair of opposed sides having a length $D_1$ and a second pair of opposed sides having a length $D_2$ and wherein a center point of each of the first and second recesses and first and second projections is located within one of first, second, third and fourth planes, each of the planes being perpendicular to the top and bottom surfaces and to one of, the first pair of opposed sides of the rectangle and the second pair of opposed sides of the rectangle, the first plane intersecting the first pair of opposed sides of the rectangle a distance $D_1/4$ from two of the corners of the rectangle, the second plane intersecting the first pair of opposed sides of the rectangle a distance $D_1/4$ from the other two corners of the rectangle, the third plane intersecting the second pair of opposed sides of the rectangle a distance $D_2/4$ from two of the corners of the rectangle, and the fourth plane intersecting the second pair of opposed sides of the rectangle $D_2/4$ from the other two corners of the rectangle.

29. The block of claim 28 wherein $D_1$ is equal to $D_2$.

30. The block of claim 28 further including at least one tunnel extending between the first and second opposed side surfaces.

31. The block of claim 28 further including a plurality of tunnels including at least one tunnel extending between the first and second opposed side surfaces and at least one tunnel extending between the third and fourth opposed side surfaces.

32. The block of claim 31 wherein the plurality of tunnels includes a plurality of tunnels extending between the first and second opposed side surfaces and a plurality of tunnels extending between the third and fourth opposed side surfaces.

33. The block of claim 28 wherein a center point of each of the central planar sections is located along one of a fifth plane and a sixth plane, both the fifth and sixth planes being perpendicular to the top and bottom surfaces, the fifth plane being perpendicular to and intersecting the first pair of opposed sides of the rectangle a distance $D_1/2$ from the corners of the rectangle, the sixth plane being perpendicular to and intersecting the second pair of opposed sides of the rectangle a distance $D_2/2$ from the corners of the rectangle.

34. The block of claim 33 further including at least one tunnel extending between the first and second opposed side surfaces, the at least one tunnel having a central axis which lies substantially along one of the first, second, third, fourth, fifth or sixth planes.

35. The block of claim 33 further including a plurality of tunnels including at least one tunnel extending between the first and second opposed side surfaces and at least one tunnel extending between the third and fourth opposed side surfaces wherein each of the plurality of tunnels has a central axis which lies substantially along one of the first, second, third, fourth, fifth and sixth planes.

36. The block of claim 33 further including a plurality of tunnels extending between the first and second opposed side surfaces and a plurality of tunnels extending between the third and fourth opposed side surfaces wherein each of the plurality of tunnels has a central axis which lies substantially along one of the first, second, third, fourth, fifth and sixth planes.

* * * * *

UNITED STATES PATENT AND TRADEMARK OFFICE

CERTIFICATE OF CORRECTION

PATENT NO. : 5,779,391

DATED : July 14, 1998

INVENTOR(S) : David W. Knight

It is certified that error appears in the above-identified patent and that said Letters Patent is hereby corrected as shown below:

Column 3, line 15, replace "darn" with --dam--.

Signed and Sealed this

Twenty-fifth Day of April, 2000

*Attest:*

Q. TODD DICKINSON

*Attesting Officer*

*Director of Patents and Trademarks*